US007510092B2

(12) United States Patent
Sholem

(10) Patent No.: US 7,510,092 B2
(45) **Date of Patent: *Mar. 31, 2009**

(54) TOOL ATTACHMENT AND ORGANIZER SYSTEM AND METHODS

(76) Inventor: Steven Sholem, 6121 N. 1st Ave., Phoenix, AZ (US) 85013

( * ) Notice: Subject to any disclaimer, the term of this patent is extended or adjusted under 35 U.S.C. 154(b) by 620 days.

This patent is subject to a terminal disclaimer.

(21) Appl. No.: 11/204,686

(22) Filed: Aug. 15, 2005

(65) Prior Publication Data

US 2006/0000788 A1 Jan. 5, 2006

Related U.S. Application Data

(63) Continuation-in-part of application No. 10/465,412, filed on Jun. 18, 2003, now Pat. No. 7,073,672.

(60) Provisional application No. 60/678,966, filed on May 9, 2005, provisional application No. 60/664,857, filed on Mar. 23, 2005, provisional application No. 60/601,522, filed on Aug. 13, 2004.

(51) Int. Cl.
*A47F 7/00* (2006.01)

(52) U.S. Cl. ..... 211/70.6; 211/87.1; 211/DIG. 1

(58) Field of Classification Search ..... 211/70.6, 211/DIG. 1, 60.1, 87.01, 11, 85.28, 88.01, 211/89.01, 131.1; 248/206.5, 683, 309.4, 248/205.2; 335/285; 40/913
See application file for complete search history.

(56) References Cited

U.S. PATENT DOCUMENTS 4,403,700 A * 9/1983 Manlove ..... 211/88.01
4,953,696 A * 9/1990 Huang et al. ..... 206/214
5,639,138 A * 6/1997 Smith ..... 294/142
5,775,518 A * 7/1998 Connor ..... 211/70.7
2003/0042218 A1* 3/2003 Bell ..... 211/88.01
2004/0245415 A1* 12/2004 Sun ..... 248/206.5

FOREIGN PATENT DOCUMENTS

GB 2084374 * 4/1982

* cited by examiner

*Primary Examiner*—Blair M. Johnson
(74) *Attorney, Agent, or Firm*—Schmeiser, Olsen & Watts, LLP

(57) ABSTRACT

A tool organizer system has a flat sheet of magnetically attracted material that attracts magnets attached to tools to support the tools on the flat sheet. The system includes position indicators that can be attached at any orientation and position on the flat sheet. The system can be provided as a kit with one or more components. A method of organizing a set of tools provides for efficient use of space and clear association between a tool and a previously selected position and avoids loss of tools by placing them in previously selected positions. A method of making a tool organizer system includes making the system in accordance with requests from a customer. The tool organizer system includes a kitchen tool organizer system that has a container with at least one magnetically attractive side and a handle, allowing the container to retain kitchen tools within the container and magnetically on the side. Attachment tools may include a fastener attachment tool that couples to a tool and provides magnetic force and a magnetic bar coupled to a tool organizer to allow metal tools to be coupled to the bar.

17 Claims, 11 Drawing Sheets

TOOL ATTACHMENT AND ORGANIZER SYSTEM AND METHODS

CROSS REFERENCE TO RELATED APPLICATIONS

This application is a continuation-in-part of the earlier U.S. Utility patent application Ser. No. 10/465,412, filed by Steven Sholem on Jun. 18, 2003, now U.S. Pat. No. 7,073,672 entitled "TOOL ORGANIZER SYSTEM AND METHODS," the disclosure of which is hereby incorporated entirely herein by reference. This application further claims priority to U.S. Provisional Patent Application Ser. No. 60/601,522, filed by Steven Sholem on Aug. 13, 2004, entitled "TOOL ORGANIZER SYSTEM AND METHODS", to U.S. Provisional Patent Application Ser. No. 60/664,857, filed by Steven Sholem on Mar. 23, 2005, entitled "MAGNETIC KITCHEN UTENSIL/TOOL HOLDER SYSTEM", and to U.S. Provisional Patent Application Ser. No. 60/678,966, filed by Steven Sholem on May 9, 2005, entitled "A MAGNETIC AND NON-MAGNETIC FERROUS FASTENER FOR STORING AND DISPLAYING TOOLS AND OTHER OBJECTS ON A METAL SURFACE," the disclosures of which are each hereby incorporated entirely herein by reference.

BACKGROUND OF THE INVENTION

1. Technical Field

This invention generally relates to tool storage and organization devices, and specifically to a storage and organization device that enables a user to selectively group and position tools with and without tool attachments on a mounting board or other mounting device.

2. State of the Art

Tool storage devices of the past include tool boxes and peg boards. Tool boxes have trays and drawers for organizing tools. Some tool boxes are large and form cabinets. Some tool cabinets also include peg boards. However, tool boxes and tool cabinets have lids or doors enclosing the tools. Furthermore, the drawers and compartments are typically stacked in a compact arrangement.

Peg boards, whether in combination with tool boxes or not, typically have a repeating pattern of holes or other mounting structure. The repeating pattern of holes or other structure provides incremental positions at which objects can be supported. Pegs are typically inserted in the holes or the other mounting structure and provide protrusions for engaging tools. Thus, the tools are typically supported at positions that can be incrementally adjusted to discrete positions corresponding to the repeating pattern of holes or other mounting structure.

There are also other various types of tools that include kitchen tools, gardening tools, barbeque tools and office tools. These various tools or utensils require various types of storage devices, such as baskets, drawers, hooks, containers and the like. Each have their own limitations and inconveniences of use. For example, a basket or container that holds kitchen tools can only hold that which fits within the container and is limited also to the height of the container, wherein only tools higher than the depth of the container can be conveniently stored in the container.

One difficulty experienced by households is that many of the same types of utensils, condiments or other kitchen products are needed each time the household sits down to eat or someone starts to cook. Conventionally, these items are stored in various cupboards and drawers, or they are stored on the countertops and table. For those stored in cupboards and drawers, it is necessary to dig through the cupboards and drawers to gather the needed items, requiring additional time to find the needed utensil buried behind or under other items in those cupboards and drawers. For items stored on the countertops and table, it again takes time to gather the needed items into one place where they are to be used. Conventional organizers of kitchen utensils are often unsightly when stored in plain view. Even conventional napkin holders that have a space for silverware in them are limited in that many items stored in the napkin holders get lost down inside the holder or become very difficult to retrieve once placed within the napkin holder.

Additionally, many tools have rounded or curved surfaces such as battery operated screw drivers, flashlights and electric/battery operated hand drills. Conventional tools of this type are manufactured in hard plastic or a non-ferrous metal like aluminum. Attaching devices are typically used to place a tool of this type on any type of storage device. The existing attaching devices are unattractive, bulky, and tend to fall off the storage device, in addition to being difficult to arrange in a neat, orderly, visually pleasing configuration.

Other conventional attachment tools include magnet bars for mounting tools to walls and the like are known. For example, magnet bars having eyelets for receiving screws, nails, or the like are known. These bars may be fastened to a wall or other surface with the aid of screws so that tools or other magnetically attractive items may be held thereon by one or more permanent magnets of the magnet bars. These bars however, are not easily moved or adjusted once they have been installed.

Accordingly, what is needed is a tool organizer system that can easily store tools of various uses in an orderly and efficient manner, without the need for various containers or storage devices, while providing attachment tools that are functional, do not fall, are easily arranged and adjusted as well as visually appealing.

DISCLOSURE OF THE INVENTION

The present invention relates to a tool storage and organization device and attachment tools that enables a user to selectively group and position tools on a mounting board. The peg boards and other storage devices of the past are deficient, on the other hand, because they limit the orientations of stored tools and the position of the tools on a support substrate. This is because the peg board holes and other mounting structures on the support substrates of past devices generally have an incremental or repeating pattern. For example, when a peg board has pre-drilled holes disposed at one inch increments, the tools supported on the peg board are located at discrete positions corresponding to the holes. This is because pegs are limited to being supported in pre-drilled holes. If a user wants to move the mounting pegs closer together or wants to group the tools by tool type, he or she is generally limited to the positions provided by the locations of the pre-drilled holes or the other incremental mounting structure.

Even in past devices in which a continuous strip of magnetic material is attached to the support substrate, the tools are limited to mounting in positions that have been predetermined by the placement of the strip of material.

The past devices are also deficient in providing a very durable hard finish to a peg board. Normally, peg boards are formed of a pressed board material and the holes for the pegs are drilled through the press board. A relatively non-durable paint may be applied to one surface of the peg board. Therefore, the peg boards of the past are vulnerable to marring during storing and retrieving of tools.

The tool boxes and cabinets of the past enclose tools that are stored therein. Even if the doors and drawers are left open, the compact nature of tool boxes and cabinets generally causes at least some of the tools in the boxes or cabinets to be layered and hidden from view. That is, the tool boxes and cabinets of the past are deficient because they generally require a user to open and close drawers and to dig for tools during their search for a particular tool.

On the other hand, in a simple form, the present invention overcomes these deficiencies and inadequacies with a tool organizer system that has a flat sheet of magnetically attracted material that is not part of another support structure. The system includes at least one tool that has a magnet. At least one position indicator is selectively placed on a front face of the flat sheet. The position indicator has a shape and/or a size adapted to match the at least one tool. The flat sheet forms a single substrate with a height, a width, and a thickness. The flat sheet has a property throughout the height, the width, and the thickness that together with the magnet holds the weight of the at least one tool on the front face of the sheet. Advantageously, the tool organizer system is structurally very simple with no element of the system that extends outside the height, the width, and the thickness and that has a property or a geometry for holding the weight of the at least one tool on the front face of the sheet.

The tool organizer system is generally for a plurality of tools and includes a plurality of position indicators. The tools can be formed from predecessor tools that have been modified by adding respective magnets. Alternatively or additionally, the tools can have embedded magnets that are integral with the tools. Importantly, the front face of the flat sheet is smooth and free of incremental holes or protrusions for mounting tools on the front face of the flat sheet. Thus, the position indicators and tools can be mounted without limitation to their positions and orientation.

In one aspect, the tool organizer system includes hook and loop fasteners connecting at least some of the tools to the flat sheet to additionally mount the tools on the flat sheet. Additionally or alternatively, the tool organizer system can have at least one additional tool with hook and loop fasteners connected to the at least one additional tool and to the flat sheet to mount the at least one additional tool on the flat sheet. Using hook and loop fasteners has the advantage of enabling mounting positions that are not limited to a particular position or orientation. However, the mounting position is established by the extra step of mounting one of hooks and loops on the support substrate, whereas using magnets and a magnetically attracted flat sheet provides unlimited positioning and orientation without the step of mounting a separate attachment mechanism to the support substrate. Furthermore, when using hook and loop fasteners, it is not easy to change the position of the attachment mechanism on the support substrate. Conversely, magnets and the magnetically attracted sheet permit changing the mounting position because the attachment mechanism is inherently provided throughout the sheet by nature of the material of the sheet. Furthermore, magnets and the magnetically attracted flat sheet have the added advantage of enabling twisting reorientation of the tools without the need to lift the tools from the flat sheet. In another aspect, the flat sheet is to be coated with a resistant finish for improved aesthetics and durability. This finish can be provided as a baked powder coating on a front face of the flat sheet.

The tool organizer system includes an additional attachment mechanism that selectively mounts the flat sheet on a wall. This additional mounting mechanism can include any of a variety of conventional mounting devices. By way of example and not by way of limitation, the additional mounting mechanism can include through holes and screws, bolts, hooks, wire, brackets, adhesive, and/or magnets. In particular, the screws can be wood, plaster, brick, or concrete screws. Furthermore, the screws can be expansion screws for mounting the flat sheet on a plasterboard or cinder block wall.

In another aspect, the present invention includes a tool set organizer system kit. The kit of the invention can include one or more of several components for packaging and distribution in accordance with customer requests. The components of such a kit can include a continuous flat sheet of magnetically attracted material that has a front face. Similar to the system described above, the front face does not have an incremental pattern of tool mounting structure. The kit may also include a set of position indicator decals adapted for placement on the flat sheet. The position indicator decals are also not incrementally limited. The kit may also include a set of tool magnets adapted to magnetically attach tools to the flat sheet. In at least some cases, the kit will include a set of tools. The set of magnets can be operatively connected to the tools or supplied separately for attachment to the tools by a user of the kit. The sets of tools, position indicator decals, and magnets can each be a set of greater than one.

In another aspect of the invention, the set of position indicators can include pictures of the tools in the set of tools to be stored. Such a set can be provided in a kit of the invention. Furthermore, the kit can include hook and loop fasteners adapted to additionally or alternatively mount the tools of the set of tools to the flat sheet. The kit can also include fasteners adapted to mount the flat sheet on a wall. Additionally, the kit can further include one or more pictures adapted for placement at any position on the front face of the flat sheet.

In still another aspect, the present invention includes a method of storing and organizing tools. The method can include mounting on a wall, an unenclosed flat sheet comprising a front face having magnetically attracted material. The method also includes selecting a tool mounting position in an area including substantially all of the front face of the flat sheet. In this step, the tool mounting position will not be limited to incremental positions. A position indicator is placed at the tool mounting position. Of course, when there are a plurality of tools to be stored, a plurality of tool mounting positions not limited to incremental positions are selected and position indicators are placed at these positions. The method of storing and organizing can alternatively or additionally include adhering a magnet or one of a hook and loop fastener to the flat sheet for connection with a complimentary portion of a fastening mechanism that resides on a tool, for example.

In one aspect, the method of storing and organizing includes the step of matching the tools with respective position indicating decals that uniquely corresponds to the tools. In another aspect, the method includes storing the tools by magnetically attracting the tools to the flat sheet at any position on the front face. The tools need not be limited to the tool mounting positions or any incremental positions. In still another aspect of the method of storing and organizing, storing the tools includes magnetically attracting at least some of the tools to the flat sheet while additionally or alternatively attaching at least some tools to the flat sheet by hook and loop fasteners.

In still another aspect, the present invention includes a method of making a tool organizer. This method can include receiving a request for at least one of a base color and/or texture, a picture to be displayed on the tool organizer, and a set of position indicators based on tools to be organized. The method of making the tool organizer can include forming the organizer of an unsupported, unenclosed, flat sheet of magnetically attracted material. The method of making can also include forming the organizer to have no incremental holes or protruding structure for supporting tools on a front face of the flat sheet. The method of making also includes providing at least one of the base color or texture, the picture, and the set of position indicators in accordance with the customer request. In one aspect, the step of receiving a request includes receiving a customer request over the Internet.

In another aspect, the method of making the tool organizer can include receiving a request for a set of tools including a particular brand. The step of providing in this case includes providing the set of tools and the set of position indicators including at least one of a particular shape, size, or color, corresponding to the particular brand. On the other hand, if the requestor already has a set of tools, he or she will simply want to match the tools that he or she has. Therefore, receiving a request includes receiving a request for matching the system with a set of tools, which may include a particular brand.

In still another aspect, the method of making the tool organizer includes providing the set of position indicators as full-size color pictures of tools of the set of tools. The method of making the tool organizer can also include receiving a request for one or more of a plurality of predetermined pictures displayed on a web site configured for Internet orders. Alternatively or additionally, the method of making can include a request for a picture, a copy of which is included in digital form together with the request over the Internet.

When the method of making a tool organizer includes a request for a base color and/or texture, the step of providing can be accomplished by electrostatically coating the flat sheet with a powder comprising a requested color and/or texture. Then the flat sheet and coating is baked at temperatures in a range from 375 degrees F. to 400 degrees F. to form a very hard, durable, yet aesthetic flat sheet.

Another aspect of the present invention includes a kitchen tool storage and organization device that enables a user to selectively group and position tools on a kitchen counter or kitchen table-top sized storage device for easy organization and access. The conventional method of storing kitchen tools, such as ladles, peelers, knives, tongs, hotpads, measuring spoons and cups, graters, thermometers and can openers. within a drawer is disorganized and makes it difficult to find the items. Other conventional approaches which use a continuous strip of magnetic, hook, or loop material permanently attached to the support substrate, the tools are limited to mounting in positions that have been predetermined by the placement of the strip of material. A final approach used with specific items such as egg timers and can openers magnetically attached to the front of a stove, a dishwasher or a refrigerator is limited in the sense that the stove, dishwasher and refrigerator are not easily moved around and often are not within reaching distance of a cook preparing a meal, and there are only very few kitchen products with magnets built into the device.

The kitchen tool organizer system of various embodiments of the present invention is intended for an entire line of kitchen-useful tools, is easily adapted to existing kitchen utensils, is easily moved to different areas within the kitchen, is attractive to display, and is easily stored within a kitchen cabinet or on the counter itself. The kitchen tools can be formed from predecessor tools that have been modified by adding respective magnets. Alternatively or additionally, the tools can have embedded magnets that are integral with the tools. Magnets such as high intensity rare earth magnets work well.

One particular embodiment of the kitchen tool organizer includes a kitchen tool storage system having a container comprising a ferrous, metallic or other magnetically attractive surface, the container being sized and shaped to receive kitchen tools therein through an opening in the top. Alternatively, the container may be substituted by a box or board with the same ferrous, metallic or other magnetically attractive surface material. The system further includes a support for the container that may be coupled to a pivoting base, though the pivoting base and support are not required for the invention.

Another embodiment of the kitchen tool organizer includes a container comprising a handle for easy carrying of the system from one location to another. The invention may also include an optional container liner. The liner may be made of a magnetically attractive material like the container, or may be made of any other suitable non-ferrous or other material such as hard or soft plastic. The liner may, for example and without limitation, be an injection molded clear plastic liner that is removable for easy cleaning. The container liner in any configuration provides for easy cleaning of the system should dirty kitchen tools be placed in the container, or food fall into it during cooking or eating.

The kitchen tool organizer system may include one or more container compartments formed integrally from a single sheet of material, or two separate containers may be formed separately of one or more pieces and placed adjacent on the same support. The container may be of any magnetically attractive material having any attractive finish known in the art, but specifically may include, without limitation, black powder coat painted cold rolled steel, chrome finish, or magnetic brushed stainless steel. Alternatively, the container may be made of a magnetic material to attract all metallic and partially metallic kitchen tools.

Another particular embodiment of a kitchen tool organizer may include a kitchen tool board of an invention related to the present application. The related invention shows many examples of the types of kitchen tools that may be adapted to attach to the container of the present invention through magnets. A magnetic strip or other magnetic tab or magnetic hook may be used as the interface between the kitchen tool and the container. A smaller version of the kitchen tool board may be used in place of the container with a horizontal support, like an upside-down "T" for similar use to hold kitchen tools for easy transportation. From the examples provided, it should be understood that the shape of the container is not limited to the examples provided herein, but may include any shaped container, with or without a compartment for holding kitchen tools.

In another aspect, the present invention may include a kitchen tool set organizer system kit. The kit of the invention may include one or more of several components for packaging and distribution in accordance with customer requests. The components of such a kit can include a container 2 made of magnetically attracted or attractive material. The kit may also include a set of position indicator decals adapted for placement on the container to indicate where particular kitchen tools may be placed. The user may select where to place each decal. The kit may also include a set of kitchen tool magnets adapted to magnetically attach tools to the container. In at least some cases, the kit will include a set of kitchen tools. The set of magnets can be operatively connected to the kitchen tools or supplied separately for attachment to the kitchen tools by a user of the kit. The sets of kitchen tools, position indicator decals, and magnets can each be a set of greater than one.

In yet another aspect of the invention, the set of position indicators can include pictures of the kitchen tools in the set of kitchen tools to be stored. Such a set can be provided in a kit of the invention. Furthermore, the kit can include hook and loop fasteners adapted to additionally or alternatively mount the tools of the set of tools to the container. Additionally, the kit can further include one or more decorative pictures adapted for placement at any position on the front face of the container.

In still another aspect of the invention, the method of storing and organizing kitchen tools includes the step of placing the position decals and then matching the kitchen tools with respective position indicating decals that uniquely corresponds to the kitchen tools. In another aspect of the method of storing and organizing, storing the kitchen tools includes magnetically attracting at least some of the kitchen tools to the container while additionally or alternatively attaching at least some kitchen tools to the flat sheet by hook and loop fasteners.

In still yet another aspect, the present invention includes a method of making a kitchen tool organizer system. This method can include receiving a request for at least one of a base color and/or texture, a picture to be displayed on the kitchen tool organizer, and a set of position indicators based on kitchen tools to be organized. The method of making the kitchen tool organizer can include forming the organizer of an unsupported, unenclosed, flat sheet of magnetically attracted or attractive material. The method of making can also include forming the organizer to have no incremental holes or protruding structure for supporting tools on a front face of the container. The method of making also includes providing at least one of the base color or texture, the picture, and the set of position indicators in accordance with the customer request. In one aspect, the step of receiving a request includes receiving a customer request over the Internet.

In another aspect of the invention, the method of making the kitchen tool organizer includes providing the set of position indicators as full-size color pictures of kitchen tools. The method of making the kitchen tool organizer can also include receiving a request for one or more of a plurality of predetermined pictures displayed on a web site configured for Internet orders. Alternatively or additionally, the method of making can include a request for a picture, a copy of which is included in digital form together with the request over the Internet.

When the method of making a kitchen tool organizer includes a request for a base color and/or texture, the step of providing can be accomplished by electrostatically coating the flat sheet with a powder comprising a requested color and/or texture. This may be done prior to bending the flat sheet into the desired container shape or after, but the coating may be damaged if bending of the sheet into the container shape occurs after it is coated. Thereafter, the container material and coating are baked at temperatures in a range from 375 degrees F. to 400 degrees F. to form a very hard, durable, yet aesthetically pleasing container.

Another particular aspect of the invention relates to an fastener attachment tool specifically for non-metal rigid materials such as plastic or aluminum/stainless steel tools. The attachment tool allows users to store tools and other objects on a vertical ferrous board attached to a wall. In particular embodiments, the fastener attachment tool may include a flexible, waterproof material, wherein the material has a non-adhesive surface and an adhesive surface and a fastening device coupled to the adhesive surface, the fastening device configured to removeably couple to a tool organizer system. The fastening device may include a magnetic plate or alternatively a metal plate to be used with a magnet. The purpose of the device is to create a magnetic attracting metal surface that would allow the device to be attached to a non-magnet attracting surface and/or curved surface of a tool. It would allow for attaching and storing tools on hooks and magnets if magnetic attracting metal is present, and other devices, such as plastic boxes containing small parts like screws.

The invention can be available in various different colors, textures, shapes, and appearances. Depending on the device for which it is intended to fasten to the board or other metal structure, the fastener attachment tool would be chosen to accommodate variously sized tools/boxes, etc. with varying reasonable weights. It is also possible that the flexible material to which the magnet or steel plate is attached might be removed and the magnet/steel plate would have a dry, industrial adhesive that would permit it to be attached directly to the tool.

In another particular aspect of the present invention, an attachment tool may include a magnetic bar supported on a magnetically attractive board for subsequent attachment of tools. The magnetic bar of the present invention may include a tray and at least one permanent magnet in the tray. The magnetic bar may further include an adhesive connecting the at least one permanent magnet to the tray. The permanent magnet may be a first permanent magnet of a plurality of permanent magnets, and the adhesive may connect the plurality of permanent magnets to the tray.

It is to be understood that the tray may be a lower tray of a pair of trays. Alternatively, the tray may be the upper tray. The permanent magnet(s) may fit snugly in the tray into which they are received. The tray may have a base and a surrounding wall to receive the permanent magnets therein. When in use the magnet bar may be placed with the tray opening facing away from the user and towards a magnetically attractive sheet so as to present a closed side of the tray for a more uniform and aesthetically attractive appearance.

An adhesive may be used to encapsulate the at least one permanent magnet. Furthermore, the at least one permanent magnet may be encapsulated between the upper and the lower trays. An adhesive may be used to fix the upper tray to the lower tray with the at least one permanent magnet therebetween.

The magnetic bar of the present invention may alternatively include the upper and lower trays having a length and a width. When the at least one permanent magnet is a first of a plurality of permanent magnets, the plurality of permanent magnets may be positioned along the length of the upper and lower trays. Other configurations of permanent magnets within the upper and lower trays are also possible.

The magnetic bar of the present invention may be formed of any of a variety of materials. For example, the upper and lower trays may be formed of polished aluminum, chrome plated material, plastic, and/or ferrous metal. The tray material may be a 24 gauge sheet or another relatively thin thickness.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
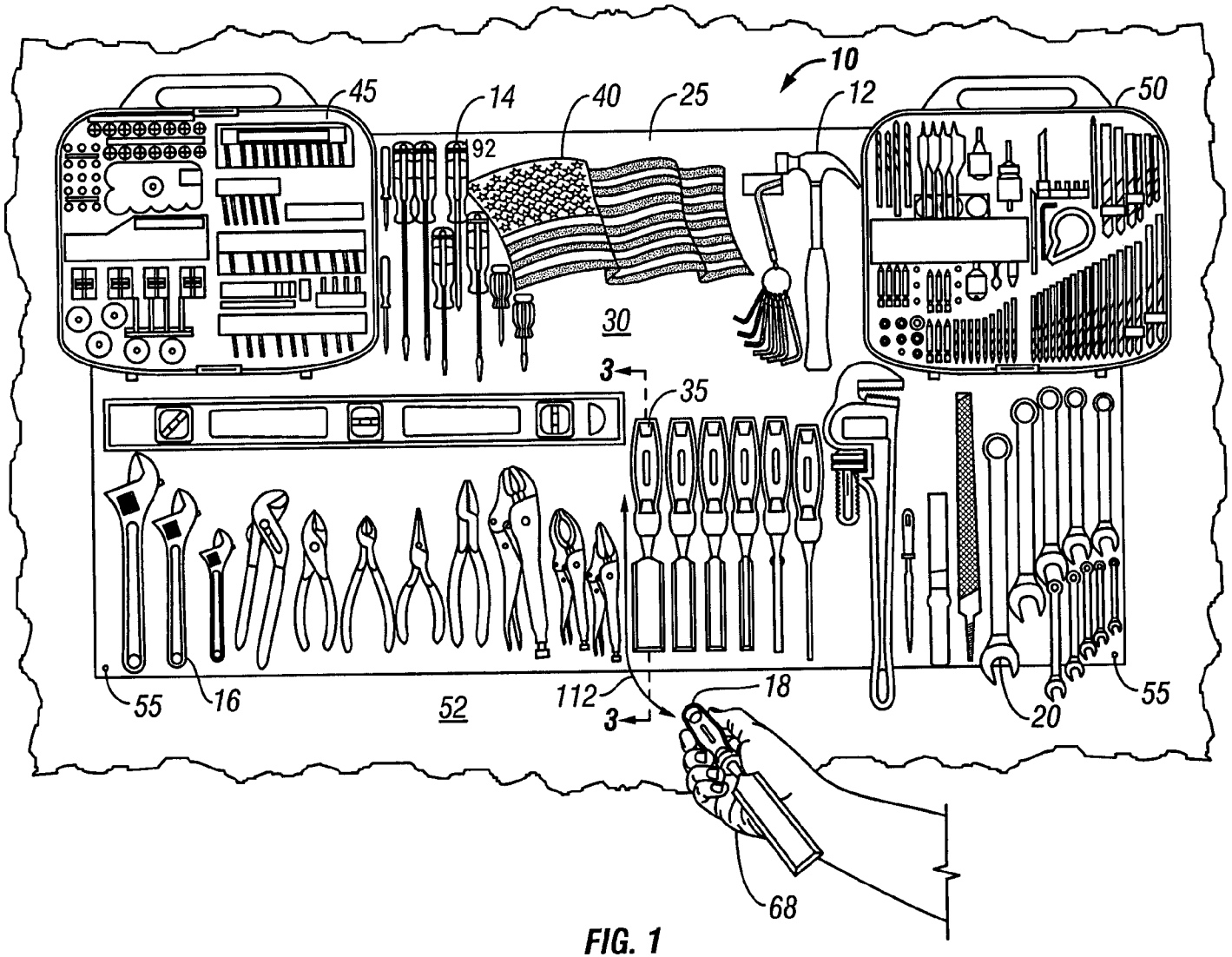
FIG. 1 is a perspective view of a tool organizer system and method of storing and organizing according to the present invention.

As discussed above, embodiments of the present invention relate to a tool organizer system 10 for storing and organizing a set of tools of which tools 12, 14, 16, 18, 20 are examples. As shown in FIG. 1, the system 10 includes a flat sheet 25 of magnetically attracted material. This material typically is made of a sheet of metal, such as ferrous metal. However, the thin sheet 25 could also comprise a composite with metal material dispersed in the sheet or a lamination with a thin magnetically attracted sheet in a front position among the laminants. The flat sheet of material includes a front face 30 for supporting the tools including 12, 14, 16, 18, 20. A position indicator as shown at 35 is provided for each of the tools to be supported on the front face 30. These position indicators 35 can take any of many forms. By way of example and not by way of limitation, the position indicators 35 can include adhesive backed decals. Other ways of providing the position indicators 35 include painting such as by stencils, or by attaching silhouette or cutouts substrates in the form of the respective tool.

In a broad sense, the position indicators 35 could take the form of color coded marks or shapes that correspond to colors applied to the tools. Furthermore, position indicators in the form of markers having shapes associated with particular tools could be used as position indicators. Further alternatively, shapes that are not associated with a particular tool or its function, but which are distinct from one another could be applied to the tool and a position at which a respective tool would be mounted on the face 30. In a particularly attractive embodiment, the position indicators 35 comprise a full sized color picture of each tool to be mounted on the face 30. In this way, confusion can be avoided and a comparison will bear out which tool is to be mounted in a particular location. With digital photo technologies, position indicator decals comprising full sized color pictures can be made and printed on sticky back decals substrates. Alternatively, similar images can be placed on plastic or vinyl sheets that can be easily pealed off and put back on a surface without a distinct adhesive layer or backing. This would have the advantages of removal and replacement without leaving a sticky or resinous residue, and decals formed in this way would be capable of repeated removal and replacement without loss of adhesive capability. Such decals include but may not be limited to those that adhere by static cling to most smooth surfaces.

Similar to the position indicator decals 35 additional pictures 40 can be provided in a similar manner. Such pictures could include advertisements, trademark(s) or pictures for decoration purposes. Pictures 40 can include flags, logos, or emblems for a sports team or other organization that provides a sense of identity for a particular user. The picture 40 can be provided as a decal or can be painted during manufacturing. The picture 40 may be an advertisement and include an illustration of a particular product such as an automobile part, for example.

Advantageously, the position indicator decals 35 and the picture 40 can be located at any position on the entire surface of front face 30 of the flat sheet 25. In this way, tools can also be positioned at any location on the front face 30 of the flat sheet 25 without covering the picture 40. Alternatively, the tools can be positioned in overlying relation to the picture 40. As shown in FIG. 1, the tools may be grouped together with other like tools for convenience and organization. Since the entire metallic sheet 25 comprises magnetically attracted material, positioning of the tools is not limited to specific incremental positions on the front face 30. Likewise, the position indicators 35 can be located at any position on the front face 30. As shown in FIG. 1, some of the tools are positioned in closely abutting relation to each other. The capability of the organizing system to enable positioning of the tools in closely abutting relation and in any orientation has great space saving advantages. This feature also allows subsets such as bit and grinder sets 45, 50 to be attached at convenient locations on the front face 30. These advantages are not achieved by peg boards which, for example, would require mounting of the tools and the bit sets at specific locations limited by the incremental attachment structure of such peg boards. Furthermore, the flat sheet 25 of the system can be conveniently mounted to a wall 52 by way of fasteners 55 as shown in FIG. 1.

Figure 2:
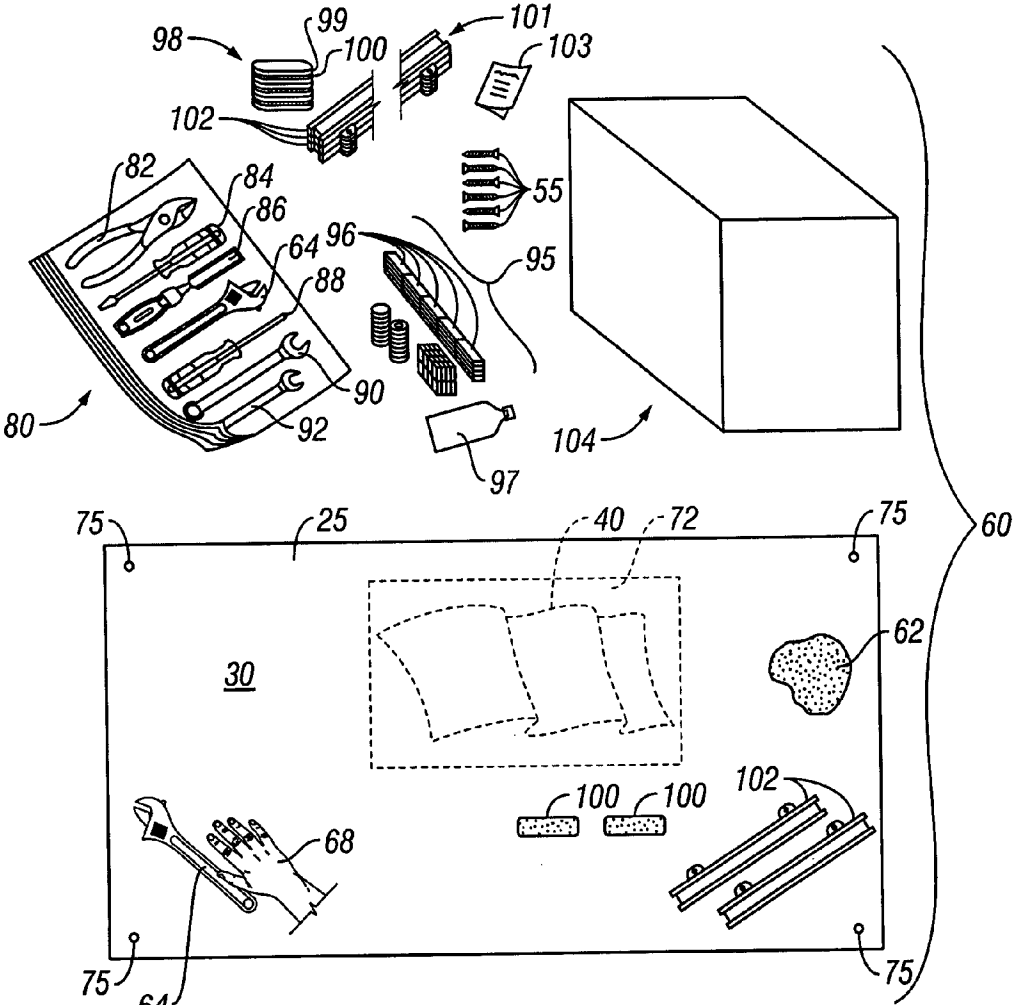
FIG. 2 is a perspective view of a tool set organizer kit and a method of storing and organizing according to the present invention.

FIG. 2 shows a kit 60 of a tool set organizer system in accordance with the present invention. The kit includes the flat sheet 25 that can be coated with a durable hard material providing at least a front face 30 with an aesthetic appearance.

The coating can be made smooth as shown in FIG. 1 or can be textured as shown at 62 in FIG. 2. A roughened or textured coating can provide the advantage of a frictional engagement by tools being held on the flat sheet. The kit also includes position indicators such as decal 64 to be placed on the flat sheet 25. The position indicators can be placed on the flat sheet 25 by a user's or a manufacturer's hand 68. Alternatively or additionally, position indicators could be painted on or otherwise provided during manufacturing. In this case, the kit may be provided without position indicators. The picture 40 can be included with the kit 60. In one embodiment the picture 40 is provided as a sticky backed decal. To this end, a sticky backed substrate 72 can be provided with the picture 40 cut out in a predetermined shape including the picture 40. Alternatively, the decals can be provided in as plastic or vinyl that adheres to the front face 30 by nature of the materials of the decal and the front face 30. As best illustrated in FIG. 2, through holes 75 are provided in corners of the flat sheet 25. Additional through holes may be provided for additional securing capability.

The kit 60 also includes a plurality of sheets 80 of position indicators in the form of decals. The position indicators include the decal 64 and additional exemplary decals 82, 84, 86, 88, 90 and 92. These decals can be selectively peeled off of the sheets 80 and selectively position on the front face 30 of the flat sheet 25 by hand as indicated at 68. It is to be understood that the sticky backed decals 64, 82, 84, 86, 88, 90, and 92 could be replaced by paper or any other substrate cut to the particular shape of the tool or simply having a silhouette or picture of the tool to be stored. With a non-sticking back, the kit may include a glue for adhering the position indicators on the flat sheet 25. Alternatively, the decals can be formed of a sheet of plastic, vinyl, or acrylic material that readily adheres to the front face 30 of the flat sheet 25 without the use of a separate adhesive or sticky backing. This can be accomplished, for example, by static cling that the particular material of the sheet tends to have. Further, alternatively, the substrates comprising the position indicators could be magnetic or have magnets attached to enable easy removal and replacement of the position indicators at any position as needed over time.

The kit may also include a set of separate magnets 95 for attachment to tools to be used with the system 10. Magnets of the set can have a variety of shapes and sizes as shown at 95. By way of example and not by way of limitation, magnets 96 of the set 95 are elongate block magnets, while others are shorter block, circular, and toroid shaped magnets. Furthermore, the magnets can be strong rare earth magnets such as Neodymium or Samarium, which, by their appearance, may have the advantage of adding beauty to the tools to which they are attached. In particular, the appearance of a Neodymium magnet can be affected by a nickel coating that is applied to protect the magnet from corrosion and cracking. The Samarium magnets may have a rough outer surface that could advantageously aid in frictionally holding the magnet and tool from sliding on the flat surface 25. Alternatively, the magnets can be ceramic or alnico. The variety and number of magnets provided should enable holding tools from four ounces to five pounds on the flat sheet. Of course, more than one magnet can be attached to a tool. However, the magnets should be of the lowest profile possible in order to avoid interference with proper function of the tool and/or discomfort to the user. The magnets can include a sticky back on one surface for attachment to the tools. Alternatively, a tube of adhesive 97 can be included with the kit for attachment of the magnets 95 to the tools.

Alternatively or additionally, the kit 60 can include a set of hook and loop fasteners 98 each comprising a hook substrate 99 and a loop substrate 100. Similarly, the kit 60 can include a set of magnetic strips 101 comprising individual strips 102. The hook and loop fasteners 99, 100 and the magnetic strips 102 can be placed at any position and orientation on the front face 30 of the flat sheet 25. Thus, hook and loop fasteners 99, 100 and magnetic strips 102 provide a similar advantage of enabling unlimited tool positioning and orientation as set forth with regard to attachment directly to the flat sheet by a magnet on the tool. However, addition of the hook and loop fastener 99, 100 or magnetic strip 102 provides a system kit 60 that is slightly less simple than a kit without the hook and loop fasteners 99, 100 or magnetic strips 102. Yet, some tools may be particularly well adapted for attachment to the flat sheet 25 by these alternative or additional mechanisms. For example, the drill bit and grinder subsets 45, 50 may benefit from attachment to the flat sheet 25 by hook and loop fasteners 99, 100 over a larger surface area of the front face 30 than is typically provided by magnets. Another advantage is that the hook and loop fasteners 99, 100 could be provided in a variety of colors, shapes, sizes, and holding strengths that may surpass those available with a set of magnets for a particular holding application. Furthermore, the magnetic strips 102 may be particularly advantageous, for example, when a magnetically attracted portion of the tool is available for attachment to the magnetic strips 102. However, the hook and loop fasteners 99, 100 and/or the magnetic strips 102 are generally intended to be incorporated in addition to the holding mechanism of magnets attached to tools and magnetically attracted directly to the flat sheet 25. Furthermore, large or heavy tools such as bit and grinder subsets 45, 50 can be magnetically supported by adding more magnets from the set of magnets 95.

The kit 60 can include a set of instructions 103. The set of instructions can include a detailed step-by-step description and/or figures to help a person prepare his or her kit for use. The set of instructions will include instructions for guiding a user during attachment of the magnets to a set of tools, for example, based on the particular adhesive being used. The adhesive 97, for example, could be a five minute epoxy that requires specific steps in preparation and application. Of course, the kit can include a plurality of fasteners 55 for engaging in holes 75 in order to attach the flat sheet 25 to a wall.

The kit 60 can also include and be sold together with a set of tools 104. This set of tools 104 can be a set of mixed and matched tools that are ordered at the time purchase of the kit 60. Alternatively, the set of tools can be a matched set. These tools may be standard off the shelf tools that are available in stores or directly from manufacturers. Alternatively or additionally, the tools in set 104 can include special tools that have been made with magnets already attached or embedded.

Figure 3:
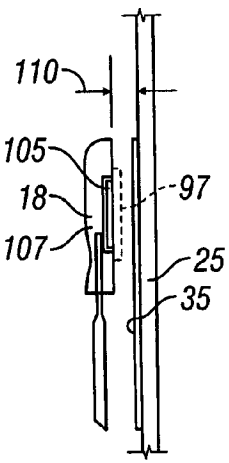
FIG. 3 is a sectional view taken along lines 3-3 of FIG. 1, with a tool positioned over the flat sheet according to an embodiment of the present invention.

FIG. 3 shows a sectional view of the tool 18 and the flat sheet 25. As shown, the tool 18 has a magnet 105 embedded in the handle 107. Alternatively, a magnet 96 from the set of magnets 95 can be attached to an exterior of the tool handle 107, for example. In either case, the tool 18 will be pulled into contact with the flat sheet 25 under the influence of the magnetic attraction between the magnet 105 or the magnet 97 and the sheet 25. This magnetic attraction will be sufficient to pull the tool into holding contact when the tool is released within a certain predetermined range 110. This range 110 is typically from zero to one half of an inch. However, with stronger magnets this range may be increased.

In one aspect, the present invention includes a method of using a system for storing and organizing tools. As shown in FIGS. 1 and 2, this method includes selecting positions for placement of a variety of tools on a flat sheet of magnetically attracted material. Once the positions have been selected the position indicators are attached to those positions as shown at 68 in FIG. 2. Advantageously, the positions for attachment of the tools are not limited to incremental positions. This is due to the fact that there are no incremental holes or other attaching structure for mounting the tools on the front face 30 of the flat sheet 25, as is typical with peg boards and the like. Once the positions have been selected and the position indicators have been placed on the front face 30, the tools may be stored in an organized fashion. FIG. 1 shows tools in superimposed relation overlapping the position indicators with which they are associated. As depicted in FIG. 1, a tool 18 can be grasped by a user's hand 68 and removed from or placed on the front face 30 as indicated by double headed arrow 112. It is intended that a tool will be stored in overlying relation with the position indicator with which it is associated. Advantageously, the system does not require the user to place the tool precisely on the position indicator. That is, if the user misses the mark, the tool will still be held to the front face 30 of the flat sheet 25 because the magnetic attraction is present at all locations on the front face 30. However, the intention is that by storing the tools in the preselected positions, the set of tools can be well organized in order to facilitate finding a particular tool when it is needed.

As an alternative to the position indicators in the form of decals shaped and sized similarly to the tools to be stored, the position indicators can be provided as outlines or cutouts in the shape of the tools to be stored. In one case for example, a sheet of material could be provided for a set of tools. This sheet of material can include outlines or cutouts of each of the tools in the set. Thus, by applying a single decal or sheet, positions and orientations for a complete set of tools can be established. Similarly, such a sheet can include cutouts for more than one set of tools on the sheet. Sheets bearing outlines or cutouts of a variety of sets of tools can be provided to include position indicators for all of the tools to be stored and organized.

In use, the present invention has the advantage of spreading the tools out in front of the user in a manner that facilitates easy access and enables the user to quickly see all of the tools, and the locations for missing tools, at once. Unlike storing the tools in a toolbox or in a cabinet, the present invention allows the user to quickly grasp a tool without having to open a drawer or dig through several other tools. To this end, it is intended that the flat sheet will be a flat sheet that is not supported in a cabinet or enclosed in any way. However, it is to be understood that the flat sheet can be of any of a variety of sizes and shapes and could be one of a plurality of flat sheets that are usable together. Each of a plurality of sheets could be mounted on one or more walls without departing from the spirit and scope of the invention. Alternatively, the flat sheets could be mounted on a pivotal axis in order to provide access to the various sheets by swinging one sheet about the axis in order to access a second sheet and so forth. In this arrangement, the sheets could advantageously be left open and unenclosed. Further alternatively, it is to be understood that separate sheets could be slidingly mounted on a wall or other support without departing from the spirit and scope of the invention. For example, a plurality of flat sheets can be placed in non-overlapping relation to enable unenclosed access to tools on the flat sheets.

Figure 4:
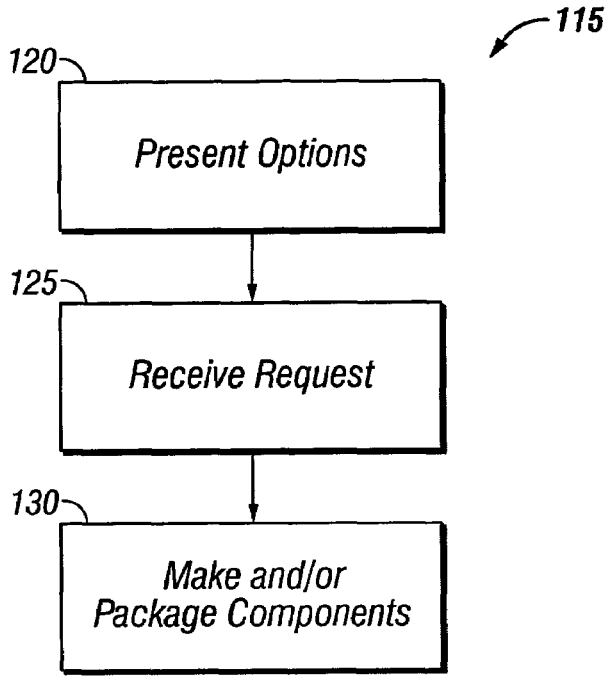
FIG. 4A is a flow chart showing the steps of a method of making the system in accordance with one aspect of the invention.

In another aspect, the present invention includes a method of making a tool set organizer system. The method of making the tool set organizer system can include making or assembling the system to include any number of the specifics set forth above. However, the method of making is not necessarily tied to the specific structure and details of the above described systems. As shown in a flow diagram 115 of FIG. 4, the method of making the tool set organizer system includes the step of presenting options 120, receiving a request 125, and making or packaging the components 130. By way of example, the method of making can include receiving a request 125 for a base color or texture for a support substrate of the system. A textured support substrate can provide the advantage of frictionally holding a magnet and an attached tool against sliding on the support substrate. The method of making the system can also include a request 125 for a picture to be displayed on the support substrate of the system. Importantly, the method of making the tool organizer system can include a request 125 for a set of position indicators based on a set of tools to be organized. Based on one or more requests 125, the system is then formed to provide an unsupported unenclosed support substrate as a flat sheet for supporting tools in an organized fashion.

Advantageously, the method of making can be facilitated by receiving requests over the Internet. This may be achieved by providing a web site for presenting the features and options that are available for the system. The requester can then access the web site via a personal computer or the like, and view the features and options that are presented. For example, the web site can have a number of pictures stored on a server, such as can be provided in association with a host computer of the tool organizer system provider. The server can be remote from the computer of the tool organizer system provider, and can be connected via the Internet to the requestor's computer and to the provider's computer. The number of pictures stored on the server provides the same number of pictures that are available for the support substrate from which the requestor can select his or her favorite(s). All the options can thus be selected and ordered over the Internet.

Advantageously, a requestor can indicate a set of tools including a particular brand for any or all of the tools. Based on the requestor's indication of these particular tools, the system can be made to include position indicators that match the particular tools. To this end the position indicators for the tools may include a particular shape, size, and/or color corresponding to the particular tools to be used in the system. In one particular embodiment, the position indicators comprise full sized color pictures of the particular tools with which the system is to be used.

To facilitate receiving the request, the options may include specific predetermined pictures or advertisements that can be included in the system. That is, a requestor can browse through a preselected set of pictures to find one or more that appeals to him or her. One option that could be made available is that the entire flat sheet could be covered with one of a plurality of preselected pictures. Alternatively, the requestor could supply the picture that he or she would like displayed on the flat sheet of his system. This aspect of the invention is particularly well suited for receiving requests over the Internet. For example, the requester could include an attached digital photo with his or her order.

Figure 5:
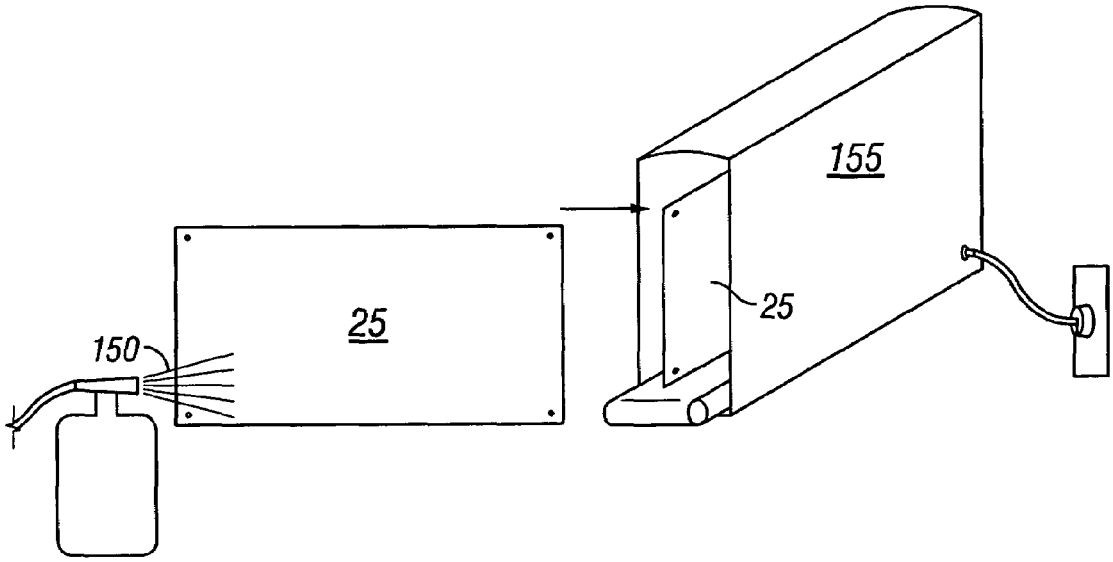
FIG. 5 is a diagrammatic perspective view of another step in the method of making the system of the present invention.

A particular finish can be requested for the front face of the flat sheet. In one form, this finish can be provided by a sprayed powder 150 that is baked at temperatures in a range from 375 degrees F. to 400 degrees F. in an oven 155 as shown in FIG. 5. The oven 155 is exemplary only, and baking the powder coat can be accomplished by open heat lamps or other heating methods and apparatuses as is well known in the art. This method of coating is provided at reduced cost when it is accomplished by an electrostatic process that holds the powder 150 on the flat sheet. The powder 150 consists of finely ground resin and pigment. While a predetermined selection of colors can be provided, it is also to be understood that a virtually unlimited range of colors and textures can be provided. These colors and textures can be provided with high to low gloss finishes with clear or metallic paints. Low gloss finishes and/or rougher textures may be utilized to better hold the magnets connecting the tools to the front face 25. That is, the rougher textures and low gloss finishes can provide a higher coefficient of friction to frictionally engage the magnets and keep the tools and magnets from sliding off the front face. It is to be understood that the finishes are intended to be of high durability so that repeated scraping and contact by tools will not easily deface the finish of the flat face 25.

Figure 6:
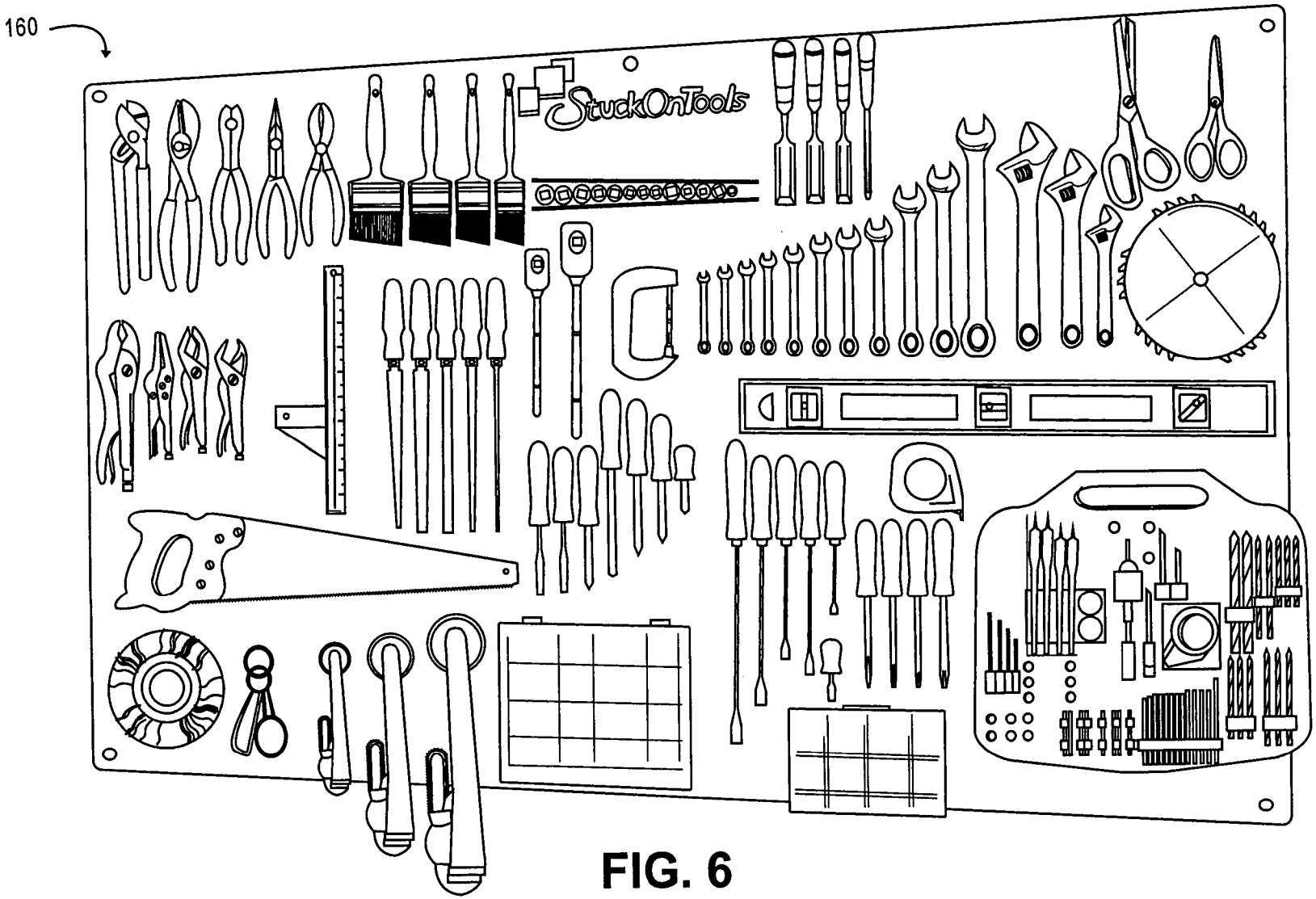
FIG. 6 is a perspective view of an actual tool organizer in substantial accordance with the embodiments of FIGS. 1-3, but with variations therefrom.

FIG. 6 is a perspective view of an actual tool organizer 160 that varies only slightly relative to the Embodiments of FIGS. 1-3 described above. The differences are predominantly in a few differences in the tools that are actually supported on the organizer. On the other hand the tools may be supported by magnets that are integral or added onto the tools in the same manner as the other embodiments described herein.

Figure 7:
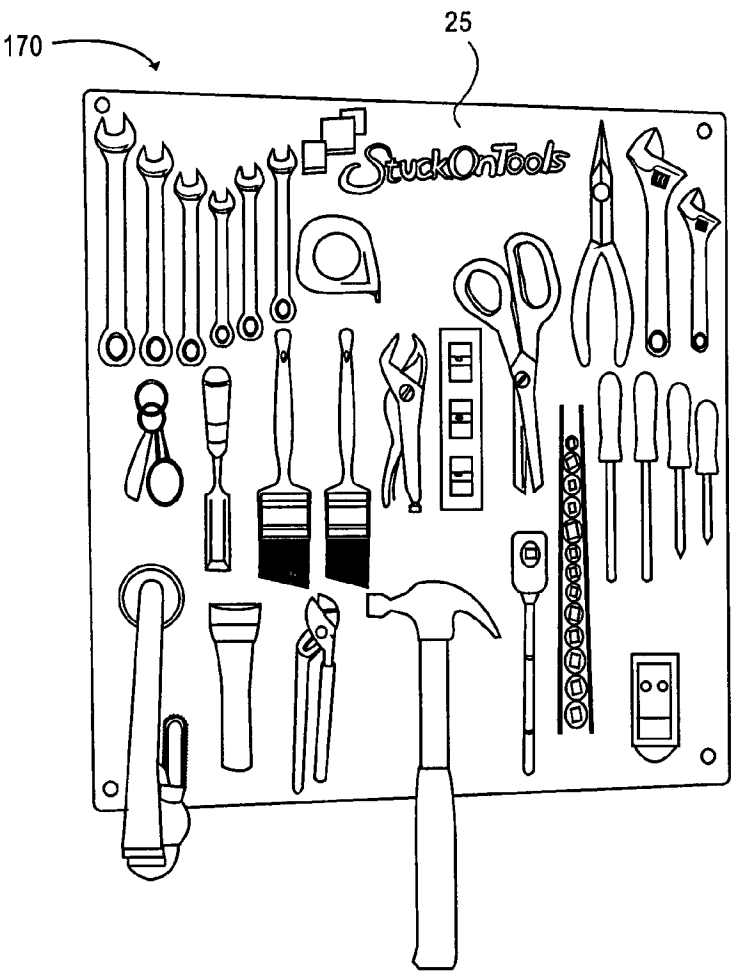
FIG. 7 is a perspective view of another embodiment of the present invention.

FIG. 7 is a perspective view of another embodiment that incorporates similar principles and structures to those described with regard to other embodiments herein. The tool organizer 170 may retain tools on the flat face 25 as shown previously in FIGS. 1-3 and 6. FIG. 7, shows an embodiment with a magnetically attractive board that is generally square. On the other hand, it is to be understood by those of ordinary skill in the art that the board could be provided of any shape and/or size. Additionally, it is noted that a larger heavier duty magnet having a hook thereon may be used to support larger and heavier tools such as a pipe wrench.

Figure 8:
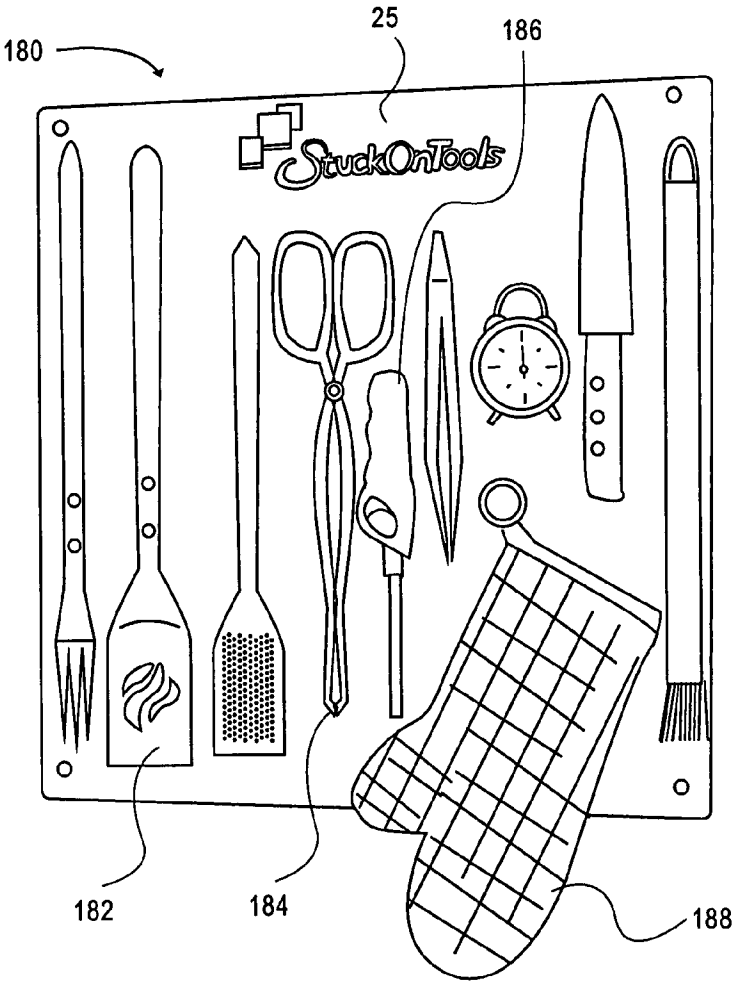
FIG. 8 is a perspective view of another embodiment of the present invention.

FIG. 8 is a perspective view of a tool organizer 180 specifically adapted for use in supporting cooking utensils, and in this case specifically barbecue tools. As such, the board of FIG. 8 magnetically adheres to tools including, but not limited to, a spatula 182, tongs 184, lighters 186 and hot pads 188 by use of the flat face 25. Other particular barbeque tools may include, without limitation, forks, wire brushes, scrapers, thermometers, timers, knifes and basting brushes. When cooking outdoors, table space is often limited and a device that conveniently and attractively supports barbecue tools is needed. The present invention does so with the embodiment and method depicted in FIG. 8. As in the other embodiments, the tools of FIG. 8 may be selectively supported by magnets that are integral with or added onto the tools in similar manners to those described with regard to other embodiments herein.

Figure 9:
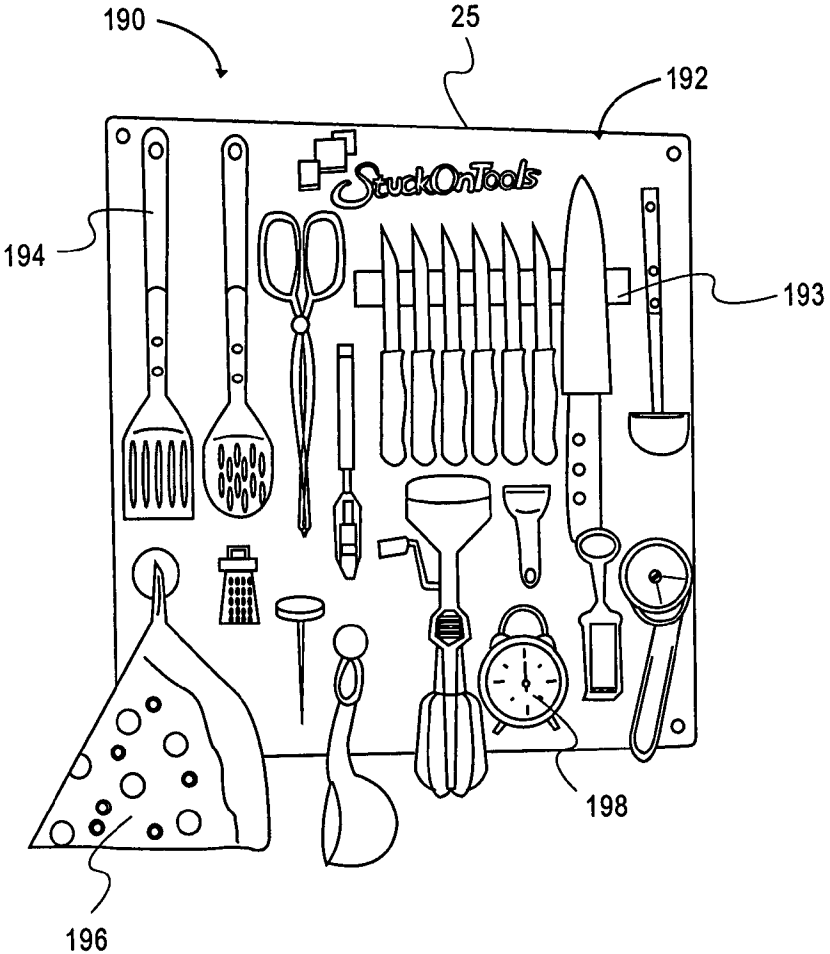
FIG. 9 is a perspective view of another embodiment of the present invention.

FIG. 9 is a perspective view of a tool organizer 190 in accordance with another embodiment of the invention. In particular, the tools supported in FIG. 9 are tools that would typically be used in a kitchen setting, such as for cooking. A board similar to those described with regard to the other embodiments may be provided having a flat face 25. Tools having magnets that are integral therewith or added on may be magnetically attracted to the board in a manner similar to those described with regard to the other embodiments herein. The tools in the embodiment and method of FIG. 9 may include, but are not limited to, knives 192, a spatula 194, hot pads 196 and timer 198, each adapted for attachment to the flat face 25 of the organizer 190. Other kitchen tool that may be used with the tool organizer 190 include, without limitation, strainer spoons, ladles and/or spoons, tongs, graters, thermometers, measuring spoons and/or measuring cups, cork screws, peelers and pizza cutters. Additional tools could be supported as well. The knives 192 may be supported on a magnetic bar 193 as described with regard to other embodiments that support sets of tools. The magnetic bar 193 may be of the type shown and described later or may be provided or constructed in another manner. The tool organizer 190 of the present invention enables a great advantage of conveniently and attractively supporting the kitchen tools in a manner that is unique and exceedingly useful. The tools are advantageously selectively positioned in a vertical plane instead of scattered on counter tops or in drawers. The same principles of providing marked positions for each of the tools may be applied to this as well as each of the embodiments of the invention. In fact, it is to be understood that the specifics of one embodiment may be applied to any or all of the other embodiments without departing from the spirit and scope of the invention.

Figure 10:
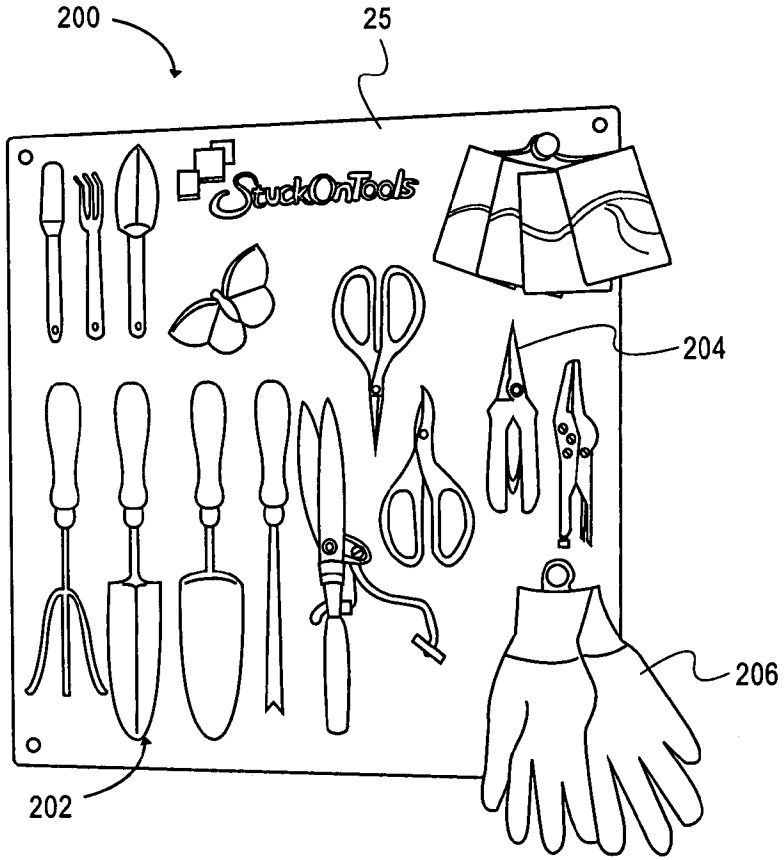
FIG. 10 is a perspective view of another embodiment of the present invention.

FIG. 10 is a perspective view of another embodiment of the present invention and includes a tool organizer 200 for gardening tools. In accordance with a method and system of FIG. 10, a variety of gardening tools may incorporate magnets that are integral with or added onto the gardening tools as described with regard to the other embodiments of the invention, and may be attached to the flat face 25 of the tool organizer 200. In this embodiment, the tools may include, but are not limited to, a variety of spades 202, pruning tools 204 and gloves 206. Other tools may include, without limitation, trowels trimming shears, cultivating tools, hand rakes, dandelion removal tools, spray nozzles and packets of seeds. As may be appreciated, one or more clips with spring biased jaws may be supported on the board by a magnet. The clips may be used to grippingly support seed packets, gloves, or other objects as desired.

Figure 11:
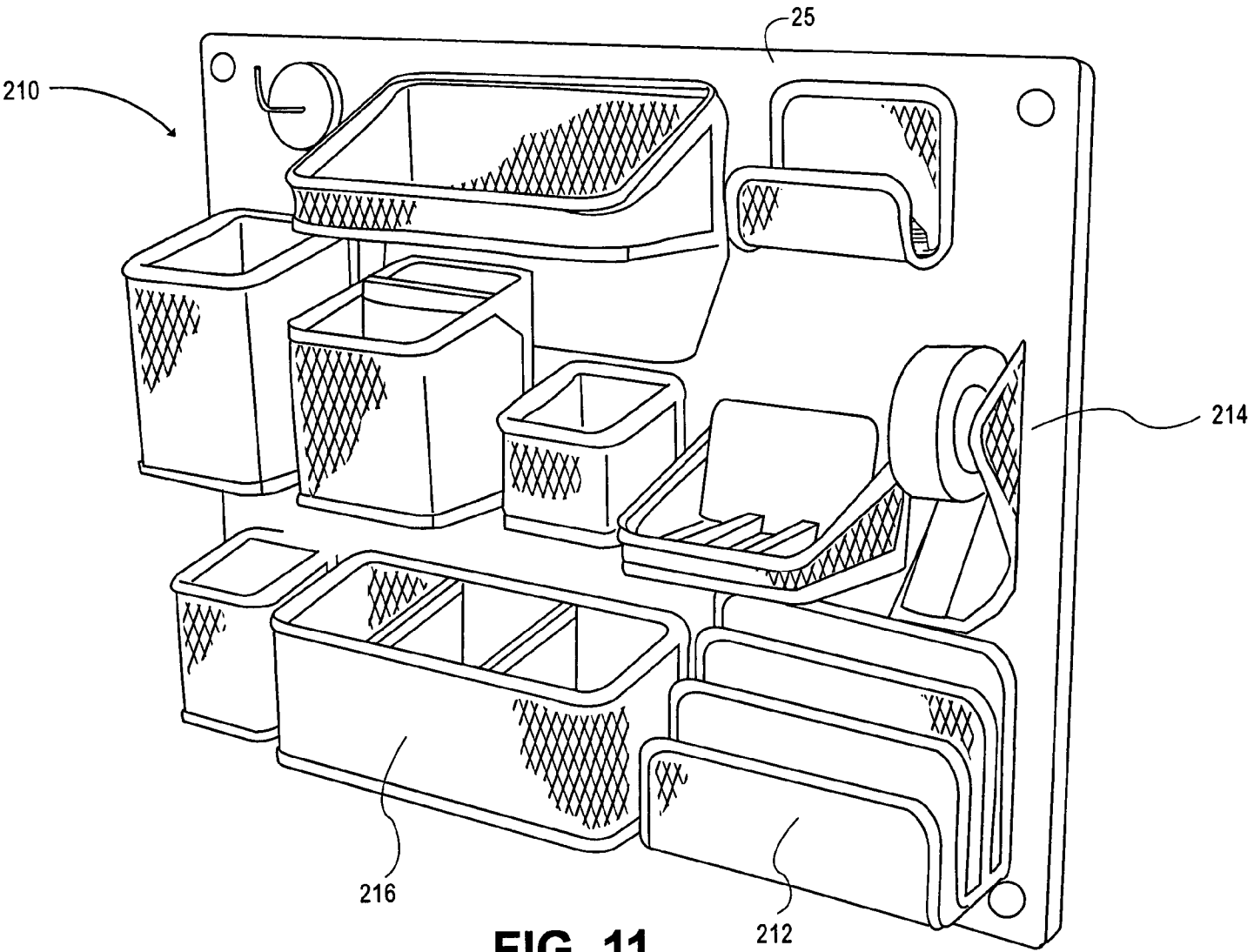
FIG. 11 is a perspective view of another embodiment of the present invention including a set of containers that may be supported on a magnetically attractive board in a manner similar to the tool organizers described herein.

FIG. 11, is a perspective view of a further additional embodiment of a tool organizer 210 of the present invention that includes a large variety of tool and accessory holders, such as, but not limited to, containers racks that are magnetically supported on a board in manner similar to those described above. Among the containers there are single and plural compartment containers 216. These compartments have generally upwardly facing openings for the purpose of receiving writing utensils, and other objects that may be useful in an office setting. The tool organizer 210 may include a flat face 25 that is configured to receive the tools and compartmented containers 216. The openings may be defined by upper edges that lie generally in planes that extend forwardly and downwardly in a position of use in order to provide the advantage of improved access to the contents and for greater ease in placement and removal of objects therein. The tool and accessory holders of FIG. 11 may include racks 212 having one or more upwardly facing slots that are adapted for receiving and supporting documents, folders, files, or other generally planar objects. As shown one of the racks has a single slot and the other has a plurality of slots. These racks 212 as well as the containers 216 may be provided with magnets that are integral or added onto a rear surface thereof to enable magnetically attractive adhesion of the containers and racks on the board. The board may be fastened at corners by fasteners that pass through the board similar to the embodiments described above. The embodiment of FIG. 11 may also have a container/rack adapted for supporting rolodex cards (slideable index cards having slots along a lower edge thereof). This container/rack may include one or more guides for slideably and removably receiving cards adapted for a rolodex therein. In this way, the container/rack may advantageously replace a desktop rolodex since the container/rack of the present invention will take up less desk space and provide for handy placement of the container/rack and its contents along a vertical plane. This same advantage is achieved for the other containers and racks herein described. Further additionally, a tape dispenser 214 may be magnetically supported on the board as shown in FIG. 11 to achieve similar advantages of reducing desktop clutter and for selective convenient placement along the vertical plane. The board may also have a magnetically supported hook supported thereon for supporting a set of keys on a key ring, or other object with a retaining hole for selective receipt on the hook.

While the magnets disclosed herein are typically of a rigid material, magnets of a flexible material could be used instead without departing from the scope of the invention. Likewise, while the position indicators are typically provided as sticky-backed decals, the position indicators could be provided on printable flexible magnetic sheets in the form of printed full size photographs of the tools to be stored. It is to be understood that the present invention can be implemented with the materials and products disclosed herein or with alternatives that function equivalently, including those that have not yet been discovered. Additionally, while the system has been disclosed primarily as having a single flat sheet for the support substrate, support substrates having contours on a front or back face are within the scope of the invention. This is especially so when the contour(s) do not provide a mechanism that, by itself, will hold a tool on the support substrate. The back face of the support substrate can be provided with any contour. In particular, such a contour can be provided to interface with a particular structure on which the support substrate is to be mounted in a more stable manner.

In another particular embodiment of the present invention, a tool organizer may be configured specifically for use with kitchen tools and utensils. It will be understood that a kitchen "tool" or "utensil" is anything that may be used or convenient to have when cooking or setting a table in a kitchen such as, without limitation, ladels, peelers, knives, tongs, pot holders, measuring spoons and cups, graters, thermometers, can openers, salt and pepper shakers, and the like.

Figure 13:
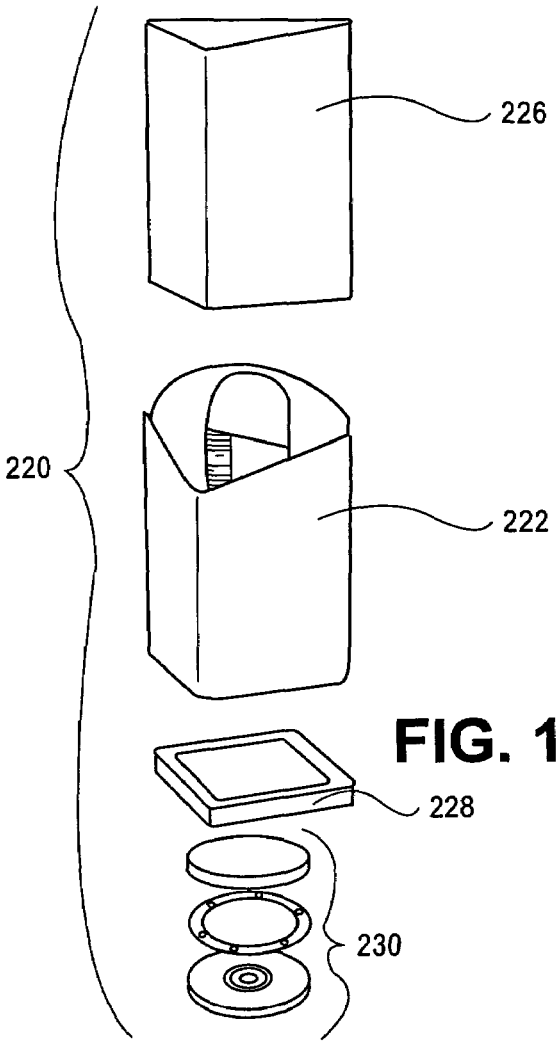
FIG. 13 is an exploded view of a kitchen tool organizer system.
Figure 12:
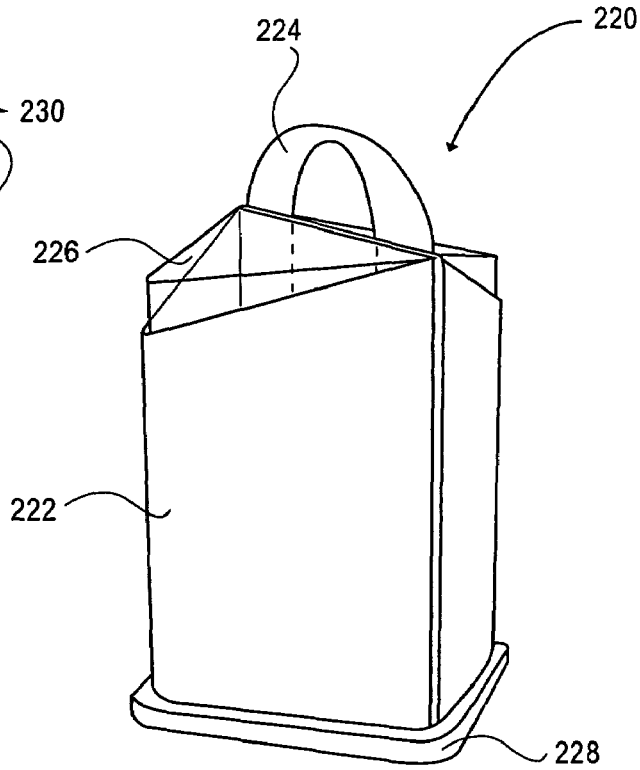
FIG. 12 is a perspective view of a kitchen tool organizer system according to an embodiment of the present invention.

FIGS. 12-13 show an example of a transportable kitchen tool organizer 220 according to a particular embodiment. The kitchen tool organizer 220 may comprise container 222 with a handle 224. The container 222 may be formed sheet metal with rounded corners, wherein at least one side is magnetically attractive. The kitchen tool organizer may also include a base 228 configured to support the container 222. The base may comprise pivoting portion 230 that allows the container 222 to pivot. In particular embodiments, the kitchen tool organizer 220 has four sides and two hollow compartments inside. Each compartment may be configured to receive a compartment liner 226. The compartment liner 226 may provide storage of non-ferrous utensils like wooden salad mixers, long plastic spoons, or long knives and other ferrous utensils that have not been adapted for magnetic attachment to the side of the kitchen tool organizer 220. The compartment liner 226 may be formed of injection molded clear plastic and are removable for cleaning or easier access, however, the compartment liner 226 may also be formed of other materials, such as metal so long as it has sufficient rigidity to retain the kitchen tools. The handle 224 may be located between the two compartments and is used to transport the kitchen tool organizer 220 as needed.

The finish on the metal portions may include black powder coat painted cold rolled steel, chrome finish, magnetic brushed stainless steel and/or any combination thereof. The pivoting base 230 may be constructed of injection molded plastic. The black, or other color, powder coat may be formed by electrostatically coating the metal with a powder having the desired color and/or texture. The coated metal may then be baked at temperatures in a range from 375 degrees F. to 400 degrees F.

Kitchen utensils may be adapted to include high intensity rare earth magnets. The kitchen tool organizer 220 may also be configured to have at least one side that is magnetically attractive or that is metallic. The kitchen utensils may then be placed at various locations on the side of the kitchen tool organizer 220 to allow the user to place, organize, access, and replace metallic or non-metallic kitchen utensils such as, but not limited to knives, can openers, measuring spoons, corkscrews, or other utensils. The utensils are replaced and held to the side of the kitchen tool organizer 220 by use of the magnets. In addition to the utensils being adapted to include integral magnets, the magnets may be externally adhered or otherwise attached to the utensils by hooks or hook and loop fasteners or by use of a fastener attachment tool as will be described later.

In other particular embodiments of the present invention, kitchen tool items may be conveniently stored within or on the side of a container for easy access. Tall items, such as a ladle, wooden spoon or spatula, may be stored inside the container or outside of the container by way of a magnet, and smaller items may be conveniently stored and organized on the outside of the container by magnetically attaching the items to the outside of the magnetically attractive side of the container. In this way, for example, a kitchen table may be set immediately with not only the napkins, knives, forks and spoons needed for the meal through a utensil and napkin caddy, but with other items needed for the meal including, but not limited to, a cork screw, bottle opener, measuring cup, hot pad, salt and pepper shaker, butter dish, and the like. Any tool conventionally used at a kitchen table can be adapted with a magnet for convenient display on the side of the container 222. When the meal is over, the tools may conveniently be stored on the container 222 and hidden upright and organized within a cupboard all at once for use later.

The kitchen tool organizer may be sold separately, or come complete with a standard set of utensils. Additionally, it may be packaged to include the accessories needed to convert standard utensils for attachment to the kitchen tool organizer 220.

Figure 14:
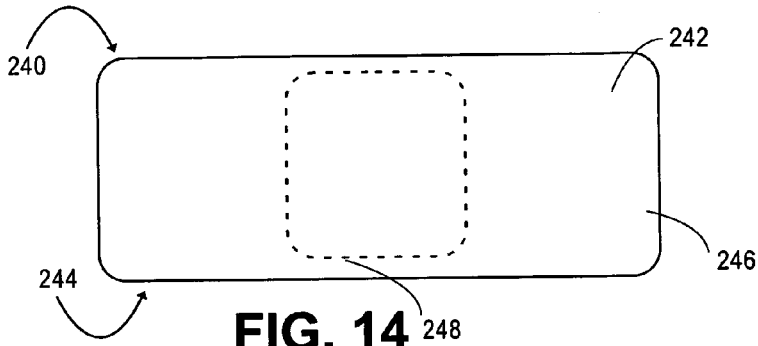
FIG. 14 is front view of a fastener attachment tool for use with a tool organizer system.
Figure 15:
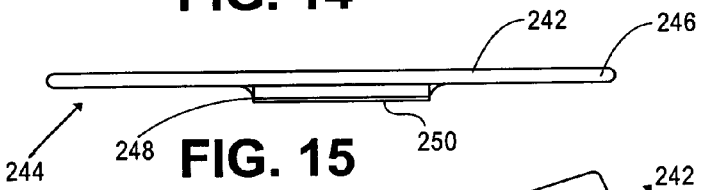
FIG. 15 is a side view of a fastener attachment tool.
Figure 16:
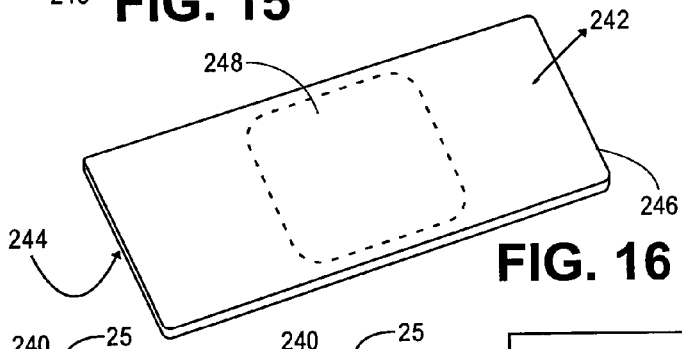
FIG. 16 is a perspective view of a fastener attachment tool.

Another embodiment of the present invention, FIGS. 14-16 shows an attachment tool that is a fastener attachment tool 240 constructed in accordance with the present invention. The fastener 240 comprises waterproof or water resistant, flexible material of varying sizes having a non-adhesive surface 242 and an adhesive surface 244 to support multiple styles, shapes, etc. The fastener 240 also comprises a fastening device 248 that is attached to the adhesive surface 244, in the center of the fastener 240, allowing for flexibility on either side of the fastening device 248. The fastening device 248 may be a flat firm rectangular device or a flexible rectangular device. The size of the fastening device 248 is variable depending on the intended use. The fastener 240 would conform to most curved surfaces and provide a strong adhesive bond to that surface by use of the adhesive surface 244.

The non adhesive surface 242 of the flexible material is exposed when in use, while the fastening device 248 would be affixed to a tool with the adhesive surface 244 of the flexible material. The fastening device 248 may comprise a magnet or a ferrous material that is used in conjunction with a separate magnet. The adhesive surface 244 may be of an industrial strength, such as an epoxy or rubber-based adhesive, and have a peel off backing. The adhesive will be of a thickness 246 allowing for full conductivity of the magnet. A cover material 250 formed of a layer of thin, flexible material, either of the same composition as the flexible material or of a different material serves to sandwich the fastening device 248 between the flexible material and the cover material 250. The flexible material may be formed of a chemical make-up similar to a pliable plastic and would be water-proof and able to continue a strong bond with the secured object under a wide range of temperatures and humidity variables found in a plurality of storage areas such as, but not limited to, work sheds, garages and basements.

Figure 17:
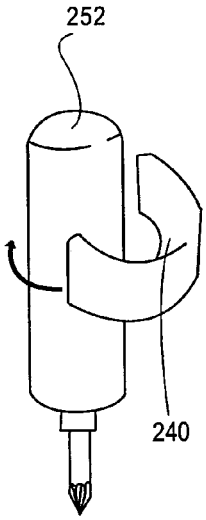
FIG. 17 is an exploded perspective view of a fastener attachment tool attached to a tool.

FIG. 17 shows the fastener 240 in use with a tool that is a battery operated screw driver. Utilizing the adhesive surface 244 to attach the device 240 to the tool 252, the flexible sides wrap around the tool and become semi-permanent. Particular embodiments of the present invention would be intended for one-time application. However, other particular embodiments may be reusable.

Figure 18A:
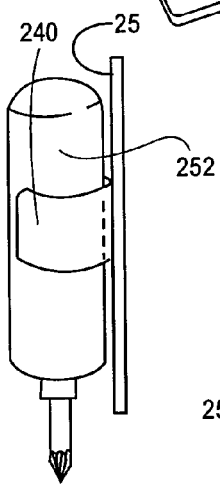
FIG. 18A is a perspective view of a fastener attachment tool with a magnetic fastening device coupled to a tool.

FIG. 18A shows the fastener 240 coupled to the tool 252 and the fastener 240 using a fastening device 248 that is a magnet. The fastener 240 may be attached to the flat face 25 of the tool organizer once the fastener 240 is on the tool. It is shown here with a small, high-intensity, rare earth magnet composed of Neodymium, a ceramic magnet, or any other of the available magnets. Practical embodiments may use more than one fastener 240 to be attached to a given tool to provide for a stronger hold to the ferrous board, allowing for a more secure attachment of a larger and/or heavier tool or object.

Figure 18B:
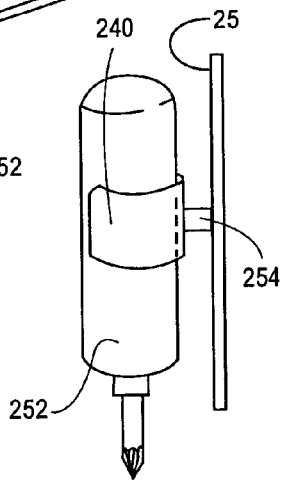
FIG. 18B is a perspective view of a fastener attachment tool with a ferrous fastening device coupled to a tool.

FIG. 18B shows the fastener 240, with a fastening device 248 formed of flat, ferrous metal. The fastener 240 is coupled to a tool 252 and is also attached to a magnet 254, wherein the magnet is attached on the vertical flat face 25 that is formed of a ferrous material.

Figure 18C:
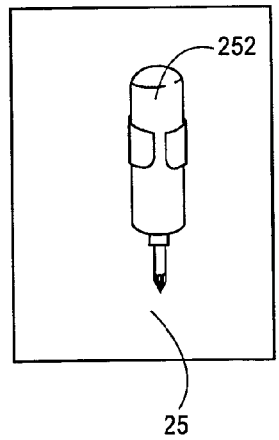
FIG. 18C is a front view of a fastener attachment tool coupled to a tool and mounted on a tool organizer system.

As shown in FIG. 18C, use of either manner of attaching the tool 252 to the tool organizer, as shown in FIGS. 18A-18B, the tool 252 may be held in a vertical position an placed in any position on the flat face 25 of the tool organizer. The tool 252 is easily moved and allows for optimal organizing of tools, even tools without magnetic attraction or metal portions.

Figure 19A:
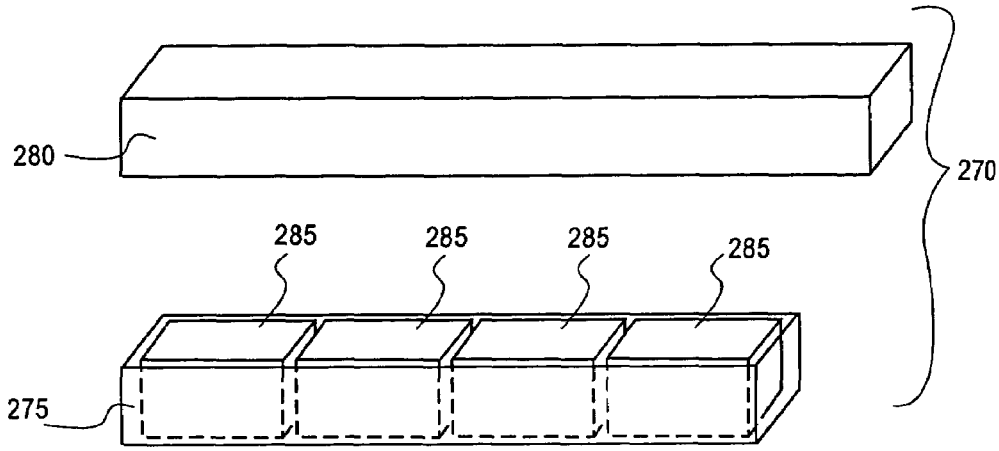
FIG. 19A is a partially exploded perspective view of the magnetic bar 170 of the present invention.

As discussed above, particular embodiments of the present invention relate to a magnetic bar for attachment to a magnetically attractive board. FIG. 19A is a partially exploded perspective view of a magnetic bar in accordance with the present invention. The magnetic bar 270 comprises a lower tray 275, an upper tray 280, and permanent magnet elements 285. The upper tray 280 is normally placed over the lower tray 275 in a covering relation. Thus, the upper tray 280 and the lower tray 275 enclose the magnetic elements 285 therebetween. In the process of making and in terms of structure, the upper tray 280 functions as a lid covering the magnetic elements 285 in the lower tray 275. In one embodiment, the upper tray 280 may be adhered or glued to the lower tray 275 to form a permanent magnetic bar 270. The permanent magnet elements 285 can also be bonded in place in the lower tray 275. As shown in FIG. 19A, the permanent magnet elements 285 may be positioned along a length of the magnetic bar 270. Alternatively or additionally, the permanent magnet elements 185 may comprise a plurality of permanent magnet elements stacked in a widthwise and/or heightwise relation to each other as indicated by dashed lines on the left hand permanent magnet element 285. Thus, any combination and relationship may be provided between loose or bonded permanent magnetic elements within the lower tray 275.

This formation of a magnetic bar 270 of a plurality of permanent magnet elements within a lower tray has the advantage of enabling the formation of a large magnetic bar from a plurality of smaller and typically less expensive permanent magnet elements. These permanent magnet elements may be held in place by an adhesive or bonding agent on inner sides and/or an inner surface of the base of the tray into which they are placed. When the tray is a ferrous and magnetically attractive material, the magnets may be held in the tray by the magnetic attraction between the permanent magnets and the tray.

Figure 19B:
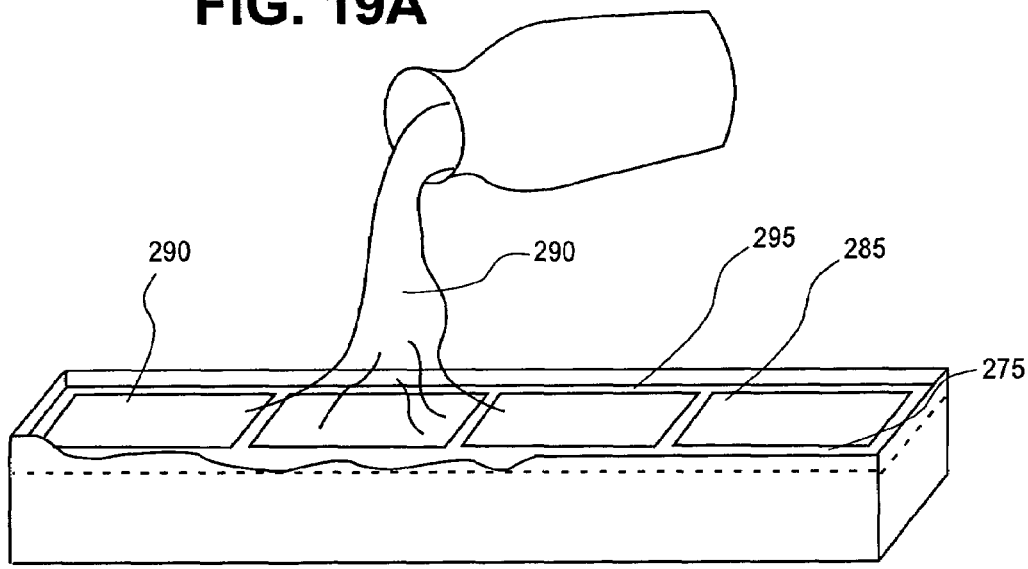
FIG. 19B is a perspective view of a lower tray magnet elements and a bonding agent being added thereto of the present invention.

As shown in FIG. 19B, the permanent magnet elements may be covered by a bonding agent 290. As shown, the lower tray may be substantially filled with the permanent magnet elements 285 and the bonding agent 290. The bonding agent 290 may be poured or injected into the lower tray 275 before, during, and/or after placement of the permanent magnet elements 285 therein. The bonding agent 290 may reach a level 295 that substantially covers or nearly covers the permanent magnet elements 285. As may be appreciated, the bonding agent may be filled to a level flush with an upper edge of the lower tray 275. With the bonding agent left to cure or dry at this level, it may be appreciated that no upper tray 280 will be needed. Alternatively, the bonding agent may be added to a level covering the permanent magnet elements 285 yet below an upper edge of the lower tray 275. In this configuration the upper edge of the lower tray 275 may be ground or otherwise removed down to the level of the bonding agent to form an integral, unitary magnetic bar 270 that does not require an upper tray 280.

Alternatively stated, only one tray may be needed, and the tray may be an upper or a lower tray. Selection of the tray and the tray sizes may be based on the availability of magnets and how well they fit snugly into a given tray. When the permanent magnet elements are covered with a bonding agent 290, the thickness should be kept small. Thus, when the tray and permanent magnet elements are inverted and mounted on a magnetically attractive sheet such as a tool hanging board, the permanent magnet elements will remain in close proximity to the magnetically attractive sheet.

It is to be understood that a thickness of the tray material of the upper and/or the lower trays 280, 275 and any bonding agent needs to be relatively thin in order to permit magnetic attraction from the permanent magnet elements 285 through the material to a magnetically attractive board and/or to a tool that has a magnet attached thereto. One approach may be to apply the bonding agent only to the sides of the tray(s) and permanent magnet elements so that surfaces of the magnetic bar facing toward and away from the magnetically attractive sheet have a relatively thin layer of material if at all between the permanent magnets and the sheet or other items to be held. Furthermore, some materials are better conductors of magnetic fields than others. For example, ferrous metals tend to block magnetic fields and therefore are not preferred materials of which to form the upper and the lower trays 280, 275. In this regard, while a chrome plated steel would be attractive, such material is not ideal for passing a maximum strength magnetic field from the permanent magnets within to magnetically attractive objects without. On the other hand, materials such as polyurethanes, polyethylenes, polystyrenes, polypropylenes, and other plastics do not impede or only impede magnetic fields minimally. Likewise aluminum only interferes minimally with the strength of magnetic fields. Polished aluminum also provides a very attractive package that permits passage of the magnetic fields. More importantly, the thickness of the trays needs to be kept small. In fact, trays 275, 280 having thin walls of any materials including plastics, aluminum, steel and/or other ferrous metals will permit sufficiently strong magnetic fields to pass therethrough. Thus, a tray of almost any material may function properly for receiving the permanent magnet elements of the present invention as long as the walls are kept sufficiently thin.

Plastic trays can be formed of colored or clear plastics. These plastics may be chrome plated of painted to appear chrome plated. These plastic trays may be formed by injection molding or by molding upper and lower trays from one or more sheets of plastic similar to clam shell plastic containers for packaging or storing food products. The lower and upper trays 275, 280 may be sized to receive the permanent magnets in a relatively snug relation. In this way, less bonding agent will be needed. Alternatively, the lower tray may be sized to matingly receive the permanent magnets, and the upper tray may matingly fit over the lower tray and form a lid. This sizing may apply equally to upper and lower trays of any material. Another approach may be to mold rubber or plastic directly around the permanent magnets so that the rubber or plastic forms an enclosure. Further alternatively, a similar enclosure for the permanent magnets may be formed by spraying on a coating of resinous material such as a heavy duty paint, plastic, or rubber material.

Figure 19C:
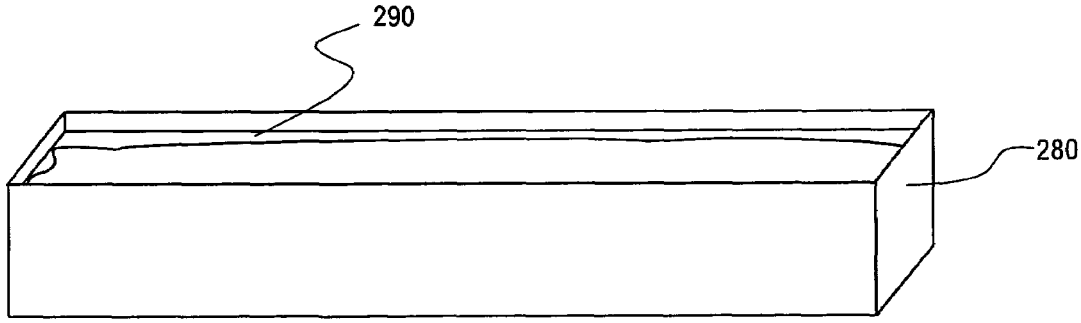
FIG. 19C is a perspective view of an upper tray inverted to show an inside of the upper tray of the present invention.

FIG. 19C is a perspective view of the upper tray 280 in an inverted position and showing a bead or otherwise applied strip of adhesive material or bonding agent 290. Thus, the upper tray 280 shown in FIG. 19A may be inverted as shown in FIG. 19C. A bonding agent 290 may be applied to an interior of the upper tray 280 and the upper tray may be placed over and bonded to the lower tray to enclose the permanent magnet elements 285. When the bonding agent 290 cures or dries, the upper and lower trays 280, 275 form a permanent enclosure surrounding the permanent magnet elements 285. Thus a magnetic bar 270 is formed.

Advantages are achieved by the present invention including providing an aesthetically attractive magnetic bar. Whether, the magnetic bar is formed of one tray, two trays, a molded enclosure, or sprayed-on enclosure, the resulting magnetic bar is an attractive component that may remain in view without cluttering or detracting from the tidiness of a user's work area. Furthermore, the tray(s), bonding material, and/or enclosure provide smooth non-abrasive surfaces for contacting the magnetically attractive sheet and/or tools. Thus, the magnetic bar of the present invention protects tools and the user's tool board from scratches and other wear.

Figure 20:
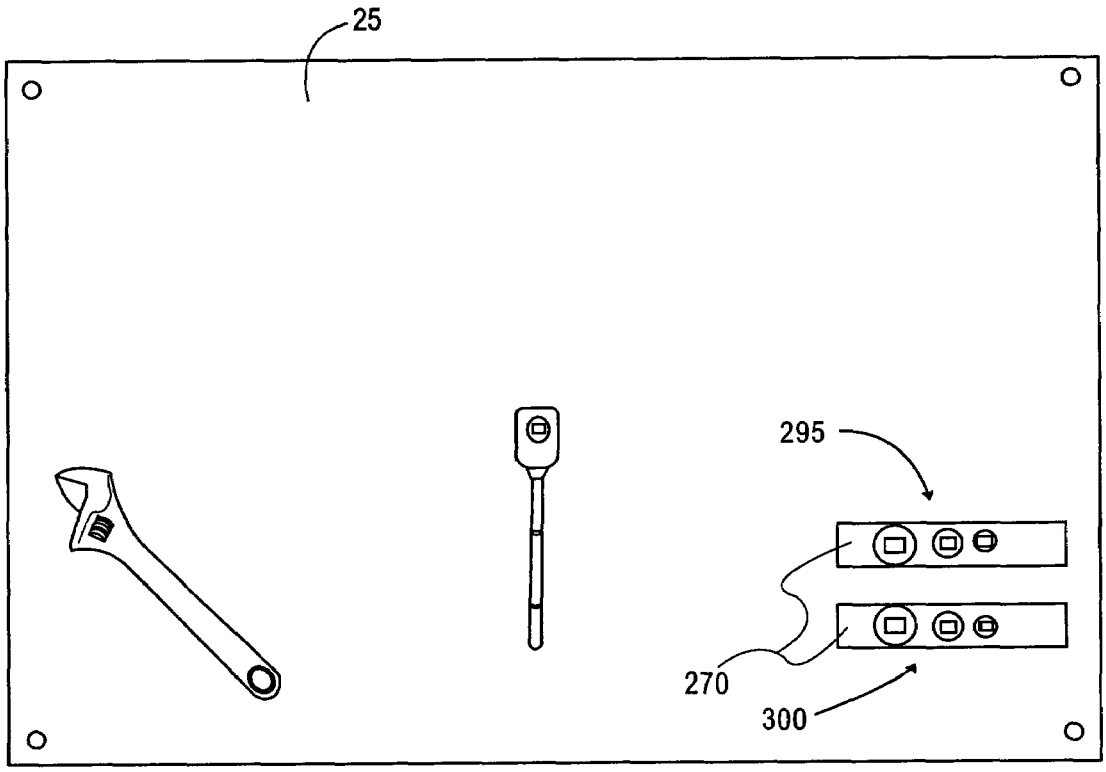
FIG. 20 is a diagrammatic view of a kit comprising the magnetic bar of the present invention.

As shown in FIG. 20, one or more magnetic bars 270 may be included in a kit as previously disclosed. In this regard, the magnetic bar 270 may be provided in addition to or in place of the magnetic strips shown in FIG. 20 of that application. FIG. 20 of this application also shows the magnetic bars 270 as they may be applied to the magnetically attractive flat face 25. As can be appreciated the magnetic bars 270 may be placed at any location and may be oriented at any angle and function to receive tools, or other items such as ratchet heads 295, 300, in a magnetically attractive manner as previously disclosed.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, while the flat sheet of the present invention is typically formed of a sheet of 20 or 22 gage steel material, any sheet including magnetically attracted material is considered within the scope of the invention.

The invention claimed is:

1. A tool organizer system, comprising:

a flat sheet of magnetically attractive material that is not part of another support structure;

a set of tools, wherein the set of tools is at least one of a set of kitchen tools, a set of barbeque tools, a set of garden tools and a set of office tools;

a set of magnets operatively connected to the set of tools;

a set of position indicators on a front face of the flat sheet; each position indicators having a shape and/or a size adapted to match each tool of the set of tools; and wherein:

the flat sheet forms a single substrate with a height, a width, and a thickness; and the flat sheet has a property throughout the height, the width, and the thickness that together with the magnet holds the weight of the at least one tool on the front face of the sheet and no other element of the system extending outside the height, the width, and the thickness has a property of a geometry for holding the weight of the at least one tool on the front face of the sheet.

2. The tool organizer system of claim 1, wherein at least some of the magnets are attached to an outer surface of a predecessor tool to form some of the tools.

3. The tool organizer system of claim 1, wherein at least some of the magnets are embedded in and integral with some of the tools.

4. The tool organizer system of claim 1, wherein the front face of the flat sheet is free of incremental holes or protrusions for mounting tools on the front face of the flat sheet.

5. The tool organizer system of claim 1, further comprising hook and loop fasteners adapted to additionally mount the tools of the set of tools to the flat sheet.

6. The tool organizer system of claim 1, wherein the set of position indicators comprise full sized color pictures of the tools.

7. The tool organizer system of claim 1, further comprising a baked powder coating on a front face of the flat sheet.

8. The tool organizer system of claim 1, wherein various components of the system are packaged and delivered to the user disassembled for assembly by the user as a kit.

9. A transportable tool organizer system comprising:

a container being of a size and shape to receive tools, the container comprising a bottom surface, an opening opposite the bottom surface, at least one liner removeably placed within the opening of the organizer, extending from the bottom surface to the opening, wherein the liner is configured to retain non-magnetic tools, a support base removeably coupled to the bottom surface of the container, and at least three side surfaces coupled together, each having an end coupled to the bottom surface and opposing ends that define the opening, wherein only one of the at least three side surfaces is a magnetically attractive surface;

a handle a fastener comprising a flexible, waterproof material, wherein the material has a non-adhesive surface and an adhesive surface; and a fastening device coupled to the adhesive surface, the fastening device removably coupling a tool to the container.

10. The tool organizer system of claim 9, wherein the magnetically attractive surface is configured to receive kitchen tools that are formed at least in part with at least one of a ferrous, metallic or magnetically attractive material.

11. The tool organizer system of claim 10, wherein the at least three sides are four sides configured in a rectangular shape providing a rectangular opening.

12. The tool organizer system of claim 11, wherein all of the side surfaces are magnetically attractive surfaces.

13. The tool organizer system of claim 9, further comprising a pivotable base coupled to the bottom surface of the container, wherein the container is pivotable when resting on the pivotable base.

14. The transportable tool organizer system of claim 9, wherein the fastening device is a magnet.

15. The transportable tool organizer system of claim 9, wherein the fastening device is a ferrous material configured for use in conjunction with a separate magnet.

16. The transportable tool organizer system of claim 9, further comprising a cover material configured to cover the fastening device.

17. The transportable tool organizer system of claim 9, wherein the waterproof material is removeably coupled to a non-magnetic tool by use of the adhesive side, wherein the waterproof material is of sufficient strength to support the weight of the tool and allow magnetic attraction through the non-adhesive side to retain the tool in a stationary position on the tool organizer system.

* * * * *